US005121952A

United States Patent [19]

Jason

[11] Patent Number: 5,121,952

[45] Date of Patent: Jun. 16, 1992

[54] SLAM LATCH

[75] Inventor: Donald M. Jason, Asbury, N.J.

[73] Assignee: Elastolatch, Inc., East Stroudsburg, Pa.

[21] Appl. No.: 730,027

[22] Filed: Jul. 15, 1991

Related U.S. Application Data

[63] Continuation-in-part of Ser. No. 506,266, Apr. 9, 1990, abandoned, which is a continuation-in-part of Ser. No. 222,086, Jul. 20, 1988, abandoned.

[51] Int. Cl.[5] ..... E05C 1/10

[52] U.S. Cl. ..... 292/175; 292/DIG. 38

[58] Field of Search ..... 292/175, DIG. 38, DIG. 60

[56] References Cited

U.S. PATENT DOCUMENTS

| | | | |
|---|---|---|---|
| 1,019,216 | 3/1912 | Bassick | 292/175 |
| 1,275,363 | 8/1918 | Barnard | 292/175 |
| 3,632,007 | 1/1972 | Kantor | 292/175 X |
| 3,724,889 | 4/1973 | Dooley | 292/175 |
| 3,850,464 | 11/1974 | Bisbing et al. | 292/175 |
| 4,320,834 | 3/1982 | Tamaki | 292/175 X |
| 4,492,396 | 1/1985 | Luke et al. | 292/DIG. 38 X |
| 4,527,821 | 7/1985 | Tanaka | 292/DIG. 38 |
| 4,542,924 | 9/1985 | Brown et al. | 292/DIG. 38 X |
| 4,790,579 | 12/1988 | Maxwell et al. | 292/175 |
| 4,917,413 | 4/1990 | Jason et al. | 292/DIG. 38 |

FOREIGN PATENT DOCUMENTS

| | | | |
|---|---|---|---|
| 07406 | 12/1986 | World Int. Prop. O. | 292/DIG. 38 |

*Primary Examiner*—Renee S. Luebke
*Assistant Examiner*—Michael Milano
*Attorney, Agent, or Firm*—Martha G. Pugh

[57] ABSTRACT

This invention relates to a one-piece latching device comprising a body of thermoplastic elastomer of specified durometer hardness having a substantially plane supporting surface, which is disposed in slidable relation in a recess or nesting site in a door or supporting panel, which comprises an elongated opening substantially in the plane of the supporting panel. One edge of the body, transverse to the supporting surface, terminates in a latching lip for engaging a striker bar or surface in cam-like fashion. The body is provided on its upper surface with means for providing a manual pull or thrust for retracting the latching lip and causing the body to slide in the direction of its opposite end, which terminates in an elastic spring member. The latter is compressed against an edge of the nesting site on the side opposite the latching lip imposing a spring-bias on the body, which causes it to slide in the opposite direction when the manual pull is released. In several embodiments, the elastic spring member comprises projections from the body of the latching device, at the end opposite to the latching lip, which are designed to squeeze into a constriction in the nesting site. In another embodiment, the elastic spring member takes the form of a finger projecting in cantilever fashion from the body of the latching device, which finger is compressed against an edge of the nesting site.

In accordance with a further modification, the upper surface of the body of the latching device is provided with one or more keyholes, and a separate tool for engaging said keyholes, and depressing a projection on said body for sliding said body back from a latched position, forcing body in unlatched position by engaging a flat boss on the inner end surface of said projection beneath the under surface of the nest panel.

10 Claims, 14 Drawing Sheets

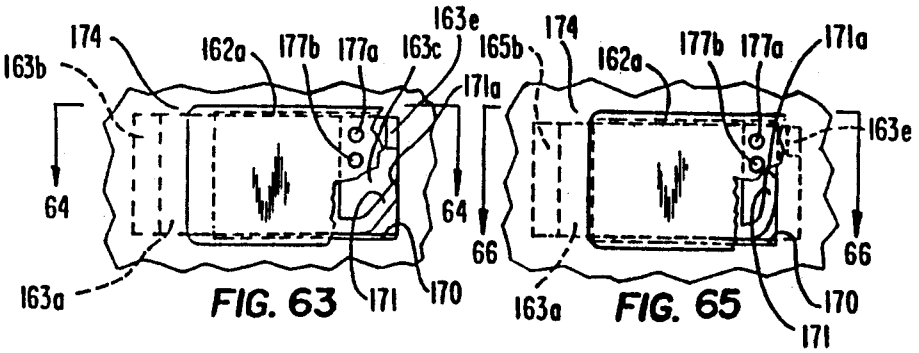
FIG. 63
FIG. 65
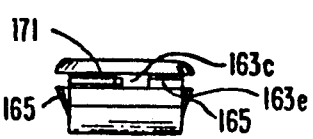
FIG. 70
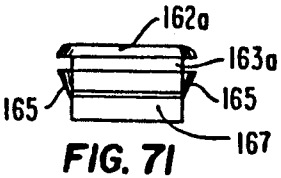
FIG. 71
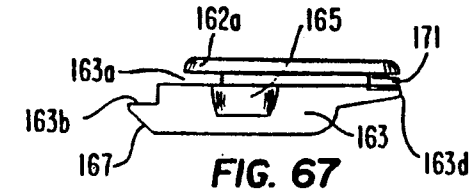
FIG. 67
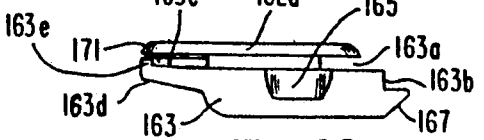
FIG. 68
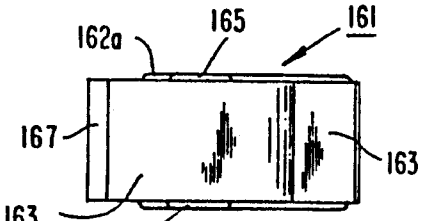
FIG. 69
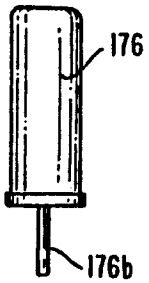
FIG. 73
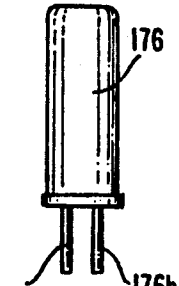
FIG. 72
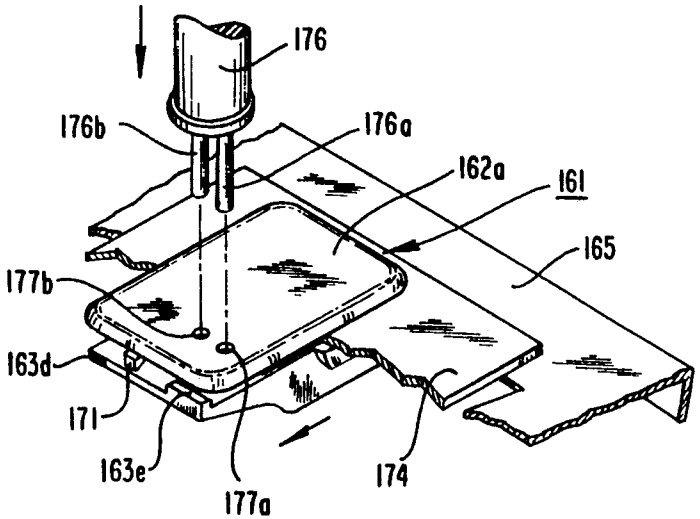
FIG. 61

SLAM LATCH

BACKGROUND OF THE INVENTION

This application is a continuation-in-part of application Ser. No. 07/506,266, filed Apr. 9, 1990 which is a continuation-in-part of application Ser. No. 07/222,086, filed Jul. 20, 1988 (now abandoned).

This relates in general to door retention devices, and more particularly to a type of latching device known as a 'slam latch'.

In providing a latching device for doors or compartments which is manually released to open, but which device latches on impact when the door is slammed shut, it is necessary that the installed device exhibit a snap action whereby it will readily release in response to a predetermined pull force from one end, or on impact of predetermined force applied to the other end.

Prior art slam latches conventionally require several mechanically cooperating parts, including a metal leaf spring or coil spring for imposing a spring-bias on the latch head, forcing it against a striker bar or panel where it is retained in its normally-closed position. Such latches require time and expense to manufacture and assemble. Furthermore, it is necessary to secure such devices in a door or panel by means of screws, or bolts or other securing devices which require tools for their installation.

SHORT DESCRIPTION OF THE INVENTION

Accordingly, it is the principal object of this invention to provide a one-piece slam latch having a spring-bias whereby the latch releases in response to a predetermined pull force exerted from one end, or in response to an impact imposed on the other end. It is a further object to provide a slam latch, of the type described, which is inexpensive to manufacture and install, and readily replaceable without the use of tools. Another object of the invention is to provide a slam latch which is substantially noiseless in operation.

These and other objects, are realized in a onepiece latching device comprising a body of thermoplastic elastomer of specified parameters, such as a durometer hardness within the range 70 on the Shore A scale to 95 on the Shore D scale. Examples of suitable material are thermoplastic elastomers sold by E. I. Du Pont de Neymours Company under the registered trademark "HYTREL", and General Electric Company under the registered trademark "LOMOD". The body of the latch has a substantially plane supporting surface for disposition in slideable relation in a recess or nesting site in the door or supporting panel comprising an elongated opening substantially in the plane of the supporting panel. One edge of the body, transverse to the supporting surface, terminates in a latching lip for engaging a striker bar or edge surface in a cam-like fashion. Means is connected to the body providing a manual pull or thrust for retracting the latching lip from the striker bar or panel and causing the body to slide lengthwise in the direction of its opposite end which terminates in an elastic spring member which is compressed against an edge of the nesting site opposite the latching lip. This provides a spring-bias which, upon release of the pull or thrust on the latch member, propels the latching means to move slideably in the opposite direction snapping closed against the striker bar or panel. A groove, or a series of bosses, around the peripheral edge, enables the latch to be installed in the recess or nesting site in a door or panel without the use of tools, or screws, or bolts.

The latch may assume several different embodiments. In one embodiment, manual pull may be exerted on a tab at one end, which may take the form of a plane rectangular piece, or a loop. In another embodiment, a depression is provided to accommodate finger pull in a lateral direction. A further embodiment substitutes a knob for thumb and finger actuation. Other means within the comtemplation of the art, may be sustituted.

It will be understood that both the nesting site and the elastic spring member may assume many different configurations and thicknesses to accommodate whatever pull force is required. In several embodiments it is contemplated that possible spring shapes can include T-shape, diamond, round, bar and L-shape which are designed to squeeze into a construction in the edge of the nest site opposite the latching lip.

In another embodiment, the spring member takes the form of a finger projecting in cantilever fashion from the end of the latch body opposite the latching lip, which finger is designed to be compressed against an edge of the nesting site.

In accordance with a further modification of the invention, an alternative is provided in which a separate tool is employed for manipulating the latch, in addition to or instead of using a finger hold for this purpose. In accordance with this modification, the latch may be forced in open position by using the tool to depress a projection at the inner end of the latch body which terminates on its upper inner surface on a small boss which slides under and engages the under surface of the panel.

The slam latch of the present invention has many advantages over those presently in use. It is a one-piece device, simple and inexpensive to manufacture and install, and replace when worn, without the use of tools, or screws or bolts. Furthermore, it is ideal for retaining a compartment, securely closed. Another advantage is that its operation is noiseless.

These and other objects, features and advantages will be better understood by reference to the attached drawings, and the detailed description thereof.

SHORT DESCRIPTION OF THE DRAWINGS

FIG. 61 shows in perspective a further modification of the embodiment of the slam latch of FIG. 49 wherein the latch is removed from the panel, designed to be actuated to an open, unlatched position by a separate tool instead of the operator's finger.

FIG. 63 is a plan view of the tool-actuated latch of FIG. 61 mounted in the rectangular nest of FIG. 62 with the top layer partially broken away to show the inwardly-projecting cantilever finger in its normally closed latched position in the rectangular nest of FIG. 62. The locking boss **163*e*** is indicated in the upper right-hand corner.

FIG. 65 is a plan view of the latch of FIG. 61 with the top layer partially broken away to show the inwardly-projecting cantilever finger in its retracted position against the edge of the rectangular nest of FIG. 62. The locking boss **163*e*** is engaged beneath the edge of the panel which is shown in dotted, phantom form.

FIG. 67 shows a side-elevational view of one side of the slam latch of FIG. 63 removed from the nest of FIG. 62.

FIG. 68 shows a side-elevational view of the other side of the slam latch of FIG. 63 removed from the nest of FIG. 62.

FIG. 69 is the bottom view of the tool actuated slam latch of FIG. 61 removed from the nest of FIG. 62.

FIG. 70 is a rear-elevational view of the tool actuated slam latch of FIG. 61 removed from the nest.

FIG. 71 is a front-elevational view of the tool actuated slam latch of FIG. 61 removed from the nest.

FIG. 72 is a front-elevational showing of the actuated tool apart from the latch shown in FIG. 61.

FIG. 73 is a side-elevational showing of the actuating tool of FIG. 72.

DETAILED DESCRIPTION OF THE INVENTION

Figure 2:
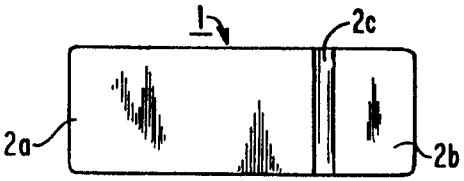
FIG. 2 is a top view of the slam latch of FIG. 1, removed from the nest.
Figure 3:
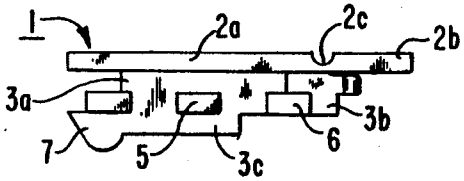
FIG. 3 is a side-elevational view of the slam latch of FIG. 1, removed from the nest.
Figure 4:
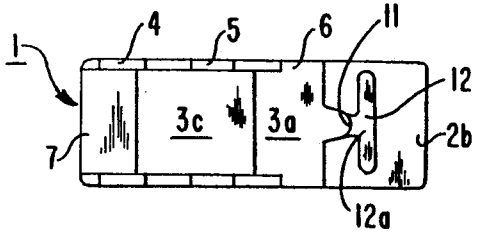
FIG. 4 is a bottom view of the slam latch of FIG. 1 removed from the nest, the latch spring in the form of a "T" with a laterally-extended bar centered on a neck extended from the body of the latch.
Figure 6:
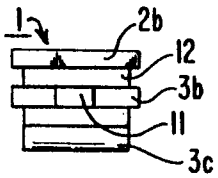
FIG. 6 is a rear-elevational view of the slam latch of FIG. 1, removed from the nest.
Figure 5:
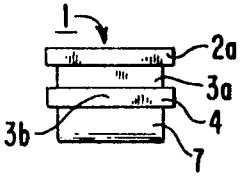
FIG. 5 is a front-elevational view of the slam latch of FIG. 1 removed from the nest.
Figure 1:
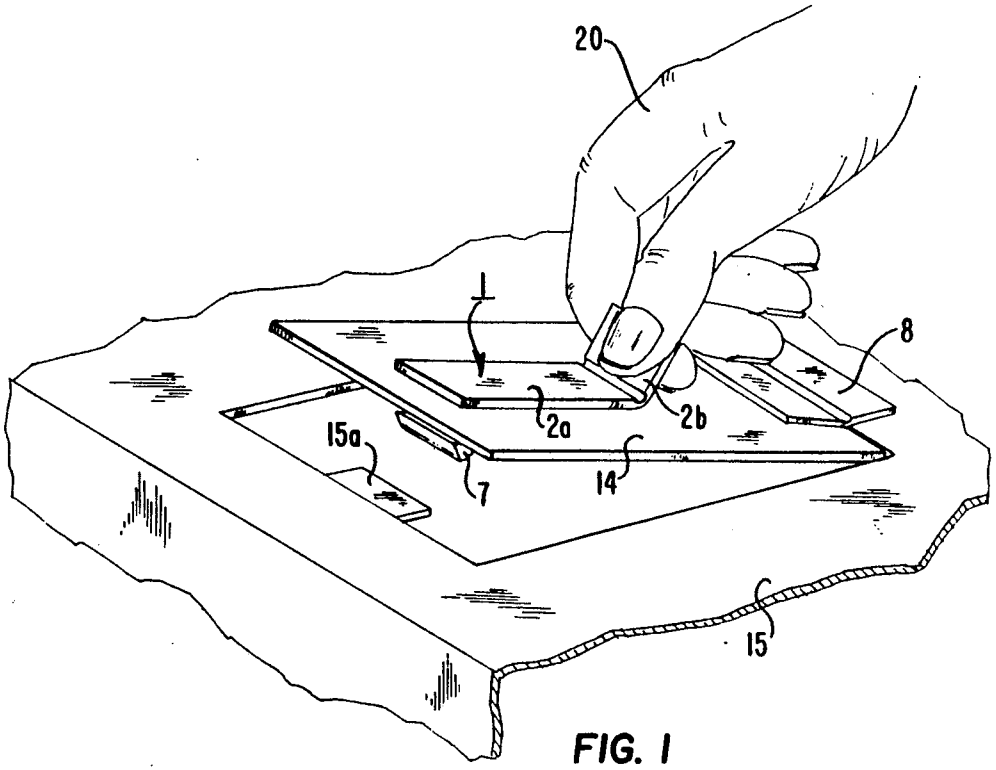
FIG. 1 is a perspective view of one embodiment of the slam latch of my invention mounted in a nest constricted at one end, wherein the latch is being manually retracted to open wherein a latch spring on the latch squeezes into the constriction.

In the illustration, FIG. 1, a panel 15 is representative or illustrative of any panel of a plane solid sheet material, say, ⅛ inch thick, of metal, wood or rigid plastic, having a rectangular opening of any desired size, which is closed by a door 14, which is connected at one edge of the rectangular opening by a conventional hinge 8.

A striker bar **15*a***, which may be, for example, ½ inch long, and, say, ¼ inch wide, projects inwardly from the center of the edge opposite the hinge.

One embodiment of the slam latch 1 of the present invention is shown being manually retracted by the hand of a user 20 to cause the latching lip 7 to become disengaged from the metal striker bar **15*a*. Alternatively, there need be no separate striker bar 15*a*; and the latching lip 7 may be constructed to directly engage one edge of the rectangular opening of panel 15. In the latter case, the door panel 14 is dimensioned to completely cover and overlay the opening by a margin of, say ¼ inch, instead of resting in the opening in closed position, in such a manner as to be flush with the surface of the panel 15**.

In one form, the slam latch 1, and the other embodiments shown and described hereinafter, are formed of a thermoplastic elastomer characterized by a durometer hardness within the range 70 on the Shore A scale to 95 on the Shore D scale. Examples of thermoplastic materials which have been found suitable for the purposes of the present invention are a polyester elastomer manufactured and sold by E. I. Du Pont de Neymours and Company under the registered trademark "HYTREL", and a silicone elastomer sold by General Electric Company under the registered trademark "LOMOD".

It is contemplated that in addition to those materials specifically listed, other elastomer materials having specified characteristics will also be useful for the purposes of the present invention. Typical limits or ranges of parameters exhibited by elastomeric materials which are deemed to be suitable for manufacture of each of the structures disclosed and claimed are indicated in the following Table I.

TABLE I

Suggested Parameters Materials Useful For Patent Invention

| Typical Parameters* | Preferred Range | ASTM TEST. NO.* |
|---|---|---|
| Durometer Hardness | 70–100 Shore A Scale and 0–95 Shore D Scale | |
| Flexural Modulus (at 23 degrees C.) | 5 to 100 MPa | D790 |
| Tensile Stress (at 5% strain) | 25 to 5000 PSI | D638 |
| Elongation at break | 10 to 1000% | D638 |
| Initial Tear Resistance (Die C) | 50 to 4000 pounds force per inch | D1004 |
| Thermostability | 100 to 1000 | D1525 |
| Vicot Softening Point | degrees F. | |
| Ozone resistance | good | |
| Fluid resistance (water vapor) | good | |

*Parameters as defined in ASTM Handbook, hereinafter referenced.

For further information relating to materials suitable for the purposes of the present invention please refer to the following which are incorporated herein by reference: *Encyclopedia of Chemical Technology*, published by John Wiley & Sons, New York, Third Edition, Copyright 1979 by John Wiley & Sons, Inc., Volume 8, Elastomers, Synthetic (survey), pages 452–635; and Volume 20, Silicon Compounds (Silicones), Silicone Elastomers, pages 943–962.

1987 *Annual Book of ASTM Standards*, Volume 08.01 PLASTICS, published by the American Society Testing Materials, 1916 Race Street, Philadelphia, Pa. 19103.

Referring to FIGS. 2–6, there is shown the slam latch 1 of FIG. 1, removed from the door panel 14. The presently described embodiment 1 has a top surface layer 2 which is 2 inches long, and ¾ inch wide, including the top surface layer of the body portion 2*a* which is 1 ½ inches long and ¾ inch wide, and the end tab 2*b* which is ¾ inch across, and projects out 7/16 inch from an integrally formed hinge, comprising a cut ⅛ inch across and, say, 3/32 inch deep. The top layer 2*a* and the tab 2*b* are both, say, 3/32 inch thick.

A second layer 3*a*, immediately below the top layer 2, is, say, ⅛ inch thick. Layer 3*a* is recessed 5/16 inch in from the front edge of top layer 2, and is centered thereon, so as to provide lateral margins of 1/16 inch on opposite sides. The layer 2*a* extends 1 inch toward the edge of tab 2*b*. Projecting from the rear is a neck 12*a*, about ⅛ inch across, and extending about ¼ inch to the rear, where it is centered on the integrally formed T-shaped spring member 12 comprising a bar 12*a* which is 9/16 inch across, 3/16 inch wide and ⅛ inch deep, which is centered on a neck 11.

The next layer 3*b*, which is integrally disposed below layer 3*a*, is also about ⅛ inch thick, ¾ inch in overall width across the front and rear, and 1¼ inches from front to back. Three bosses 4, 5 and 6, (identical on each side), each about ¼ inch from front to back and 1/16 inch thick, and ⅛ inch deep, are equally spaced-apart, being separated by rectangular notches ¼ inch wide.

A bottom layer 3*c*, say, 3/32 inch deep, is stepped back ⅜ inch from the rear edge of layer 3*b*, being ⅝ inch wide, and centered across the width of 3*b*. The overall length of layer 3*c* is 1 inch, terminating at its forward end in the latch lip 7, the upper surface of which projects out ⅛ inch from the forward end of layer 3*b*. The latch lip 7 projects downward to an overall depth of 3/16 inch below the bottom of layer 3*b*, and 2/16 inch below the lower surface of 3*c*, being of general parabolic section, so that the projecting upper front end surface is substantially flat, being curved across the bottom.

Figure 10:
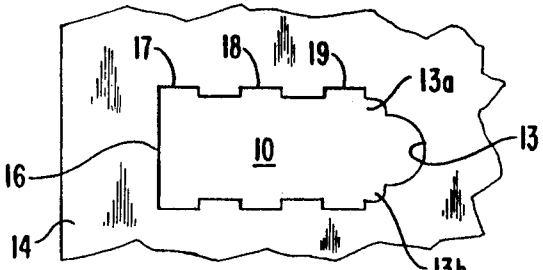
FIG. 10 shows the metal nest of FIG. 1, constricted at one end, with the latch removed.

The consricted nest or recess into which the latch 1 is snap-fitted is shown in FIG. 10. This is cut through the thickness of the door panel 14, and is 1⅝ inches in overall length, and ¾ inch across at the front, or latch end. Each of the sides is provided with matching notches 17, 18 and 19, each ¼ inch wide from front to back and 1/16 inch recessed in a lateral direction. The front notches 17 extend back ¼ inch from the latch edge 16, and are equally spaced from the middle notches 18, and the rear notches 19 by intervening bosses, each ¼ inch wide. To the rear of the notches 19 are a pair of shoulders 13*a*, 13*b*, which are each in the shape of curves with radii say, 1/16 inch. Centered between the shoulders 13*a*, 13*b* is a semi-circular slot or constriction 13, ⅜ inch across the widest portion, and having a radius of, say, 3/16 inch.

Figure 7:
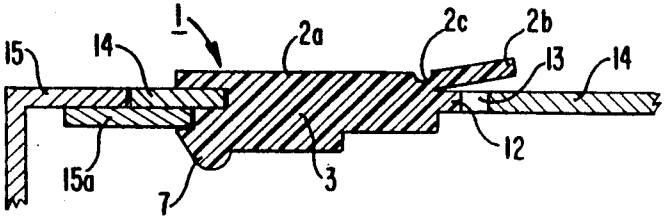
FIG. 7 is a longitudinal sectional view of the slam latch of FIG. 1, in normally-closed position in the nest of the form of FIG. 10.
Figure 8:
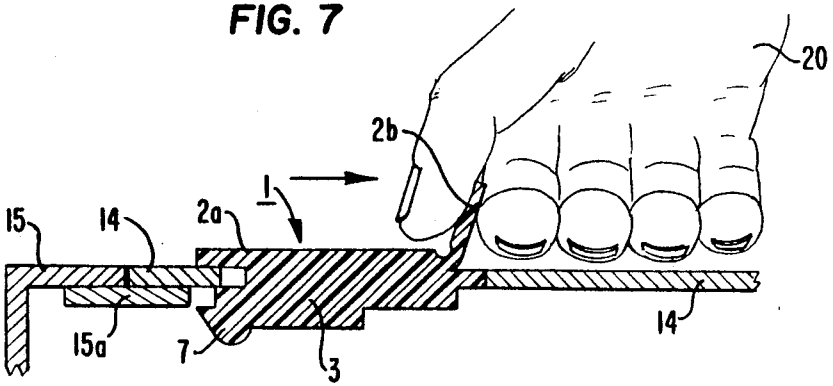
FIG. 8 is a longitudinal partial sectional view of the slam latch of FIG. 1 in the process of being manually retracted in the constriction in the nest of FIG. 10 to disengage it from the striker bar.
Figure 9:
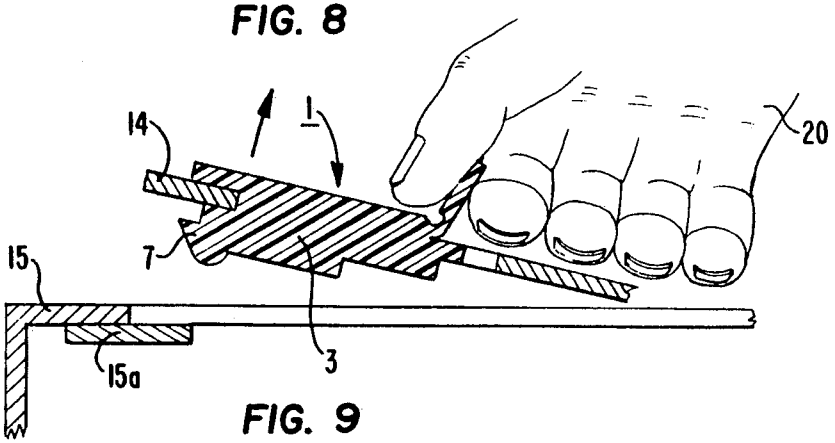
FIG. 9 shows a partial sectional view of the slam latch of FIG. 1 completely disengaged from the striker bar and lifted up.

FIGS. 7, 8, and 9 are longitudinal sections of the latch 1 in place in the door panel 14, respectively shown in closed position against the striker bar 15*a*, in retracted position by manual operation of the tab 2*b*, and in open position with the latch 7 disengaged.

The latch 1 as shown in FIGS. 2–6, snap-fits into place in the constricted nest 10, shown in FIG. 10, so that the edges of under surface of top layer 2 lie flat on the surface of door panel 14. The bosses 4, 5 and 6 on each of the sides, form slots about ⅛ inch wide between their upper surface and the lower edge surfaces of 2 in which the latch 1 moves slideably in a lengthwise, lateral direction in response to a pull on the tab 2*b*, in partial contact with the upper surfaces of the projections between 17, 18 and 19 on the two sides.

Figure 11:
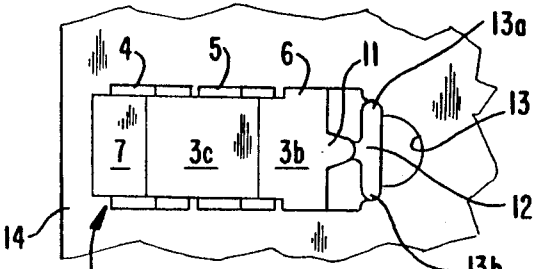
FIG. 11 is bottom view of the slam latch of FIG. 1 mounted in the metal nest of FIG. 10, in normally-closed position in which the spring member is T-shaped terminating in a laterally-extending bar centered on a neck portion.

FIG. 11 is a bottom view of the latch assembly of FIG. 7 showing the latch 1 in closed position, with the plastic T-shaped spring member 12 in its rest position straight across with its ends against the internal shoulders 13*a*, 13*b*. In this position, the latch lip 7 is engaged with the striker bar 15*a*.

Figure 12:
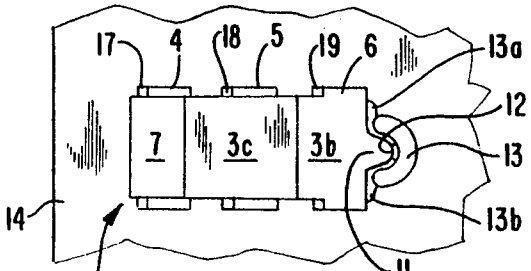
FIG. 12 is a bottom view of the slam latch of FIG. 1 mounted in the constricted metal nest of FIG. 10, in retracted position.

FIG. 12 is a bottom view of FIG. 8, with the latch in operated retracted position, showing the plastic spring member 12 which has been pushed in a lateral direction, with the central portion deformed into a loop which is constrained in the curved slot or constriction 13. This releases the latch lip 7 from engagement with striker bar 15*a*, and produces a spring-bias. As soon as the manual pull is released on the tab 2*b*, this spring-bias propels the latch 1 to slide laterally in the opposite direction, causing the latch lip 7 to assume its released position. Thus, when the door 14 is again closed by being pressed against panel 15, the striker bar 15*a* presses against the curved underside of the latch lip 7, sliding into the undercut slot between the lower surface of the door panel 14, and the upper surface of lip 7. The latter projects out about ⅛ inch beyond the edge surface of layer 3*b* of the latch body 3, forming a slot which is about ⅛ inch wide and ⅛ inch deep, which just accommodates the edge of the striker bar 15*a*, when the latter snaps into place, holding the door closed securely.

Figure 13:
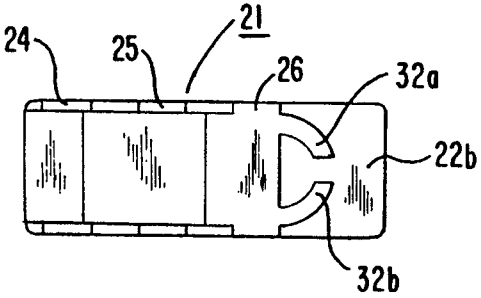
FIG. 13 shows a bottom view of a modified slam latch of the present invention, removed from the nest, wherein the spring comprises a pair of arms or flaps disposed in curved open position.
Figure 15:
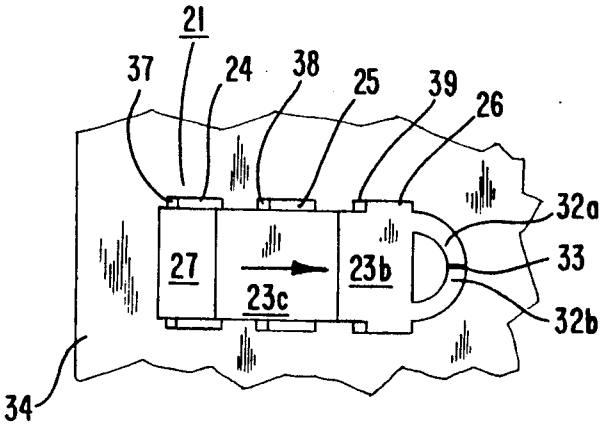
FIG. 15 shows a bottom view of the slam latch of FIG. 13 mounted in the constriction of the nest of FIG. 10, in retracted position, wherein the curved arms or flaps are moved into contacting position.
Figure 14:
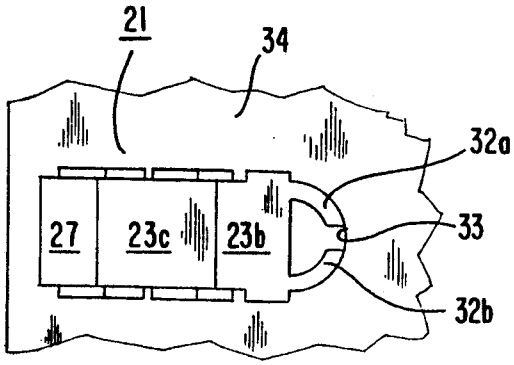
FIG. 14 shows a bottom view of the modified slam latch of FIG. 13, mounted in the nest of FIG. 10, in normally-closed position, wherein the spring comprises a pair of convex arms or flaps.

Referring to FIGS. 13, 14 and 15, there is shown a slight modification 21 of the latch 1 described with reference to FIGS. 1–12, in which the spring member 12, which is designed to be deformed into a loop, is replaced by a pair of curved arms 32*a* and 32*b* which are connected to opposite sides of the inner edges of layer 23*b* of the body of the latch 21. 32*a* and 32*b* from between them a semicircle which is not quite closed at the center, the inner ends of 32*a* and 32*b* being spacedapart about ⅛ inch in rest position.

It will be understood that in FIGS. 13, 14 and 15, twenty digits have been added to the designating numbers used in FIGS. 1–12, so that, unless otherwise indicated, the description of individual elements will be substantially the same as previously given with reference to their correspondingly numbered counterparts in FIGS. 1–12. FIG. 14 shows the latch 21 of FIG. 13 mounted in the constricted nest in door panel 34, with the latch in closed latched position, with the ends of curved arms 32*a* and 32*b* spaced-apart in slot or constriction 33.

FIG. 15 shows the latch 21 in retracted position, in response to a pull on the tab 22*b*. In this condition, with latch 21 moved in a lateral direction to the right, the ends of curved arms 32*a* and 32*b* are squeezed together into the curved slot or constriction 33 to provide a spring-bias when the pull on tab 22*b* is removed.

Otherwise, the latch 21 is similarly structured, and operates in the same manner as latch 1 previously described.

FIGS. 16–25 show another modification of 41 of the latch of the present invention, namely, a finger actuated latch. It will be understood that 40 digits have been added to the designating numerals, the descriptions of the parts being similar unless otherwise indicated.

Figure 17:
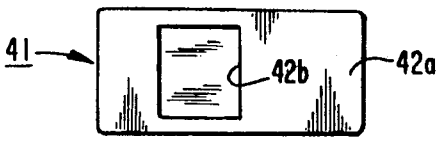
FIG. 17 is a top view of the slam latch of FIG. 16 removed from the nest.
Figure 18:
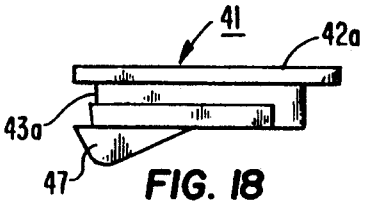
FIG. 18 is a side-elevational view of the slam latch of FIG. 16 removed from the nest.
Figure 16:
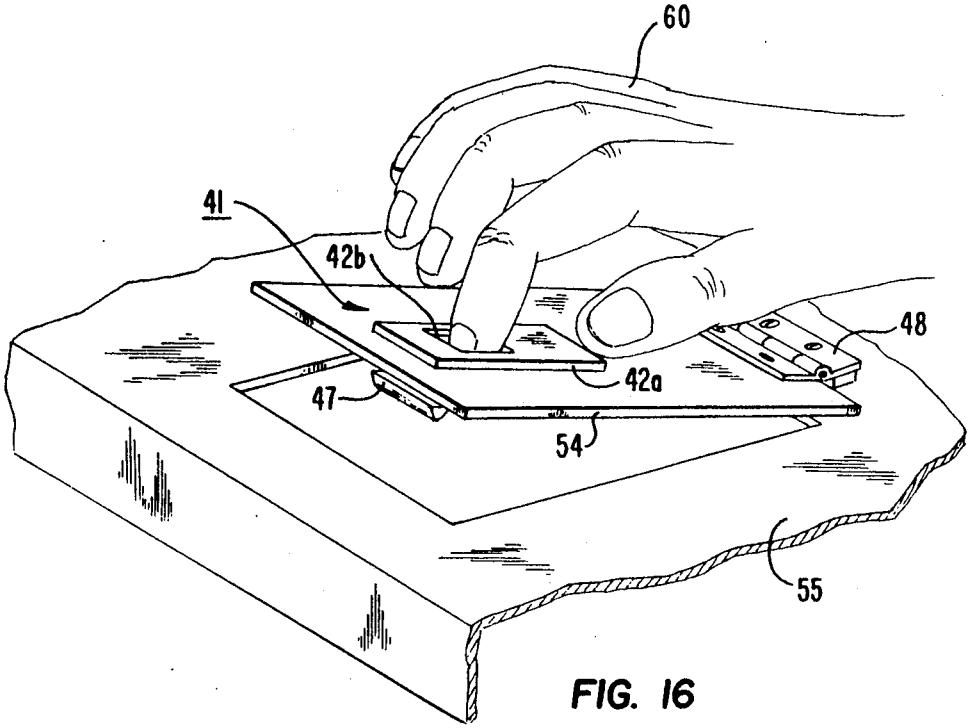
FIG. 16 is a perspective showing of another embodiment of the slam latch of my invention mounted in the constricted nest of FIG. 23 in the process of being manually retracted.

FIG. 16 is a perspective showing of the finger actuated latch 41 installed on a door panel 54 which is connected by hinge 48 to one edge of a rectangular opening in the panel 54 having a constriction at the inner end. Latch 41 is shown being retracted by a finger from a hand 60 of a user. The finger is inserted into a recess **42*b*, located, say, 5/16 inch from the forward end of the top layer 42*a*. Recess 42*b*, may be, for example, ½ inch square on the top surface 42*a*, and, say, ¼ inch deep, and shaped to accommodate the finger. The top layer 42*a* of latch 41 is rectangular, 1½ inches long, ¾ inch wide, and ⅛ inch thick. A top view of latch 41 removed from its nest is shown in FIG. 17, in side elevation in FIG. 18**.

Figure 19:
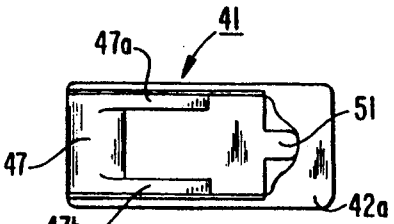
FIG. 19 is a bottom view of the slam latch of FIG. 16 removed from the nest, showing a spring terminating in a rearward projection having a convex end portion.

FIG. 19 is a bottom view of the latch 41.

Figure 21:
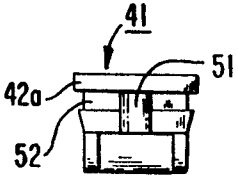
FIG. 21 is a rear view of the slam latch of FIG. 16 removed from the nest.
Figure 20:
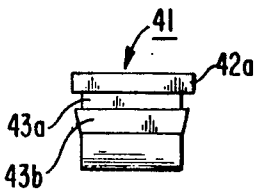
FIG. 20 is a front view of the slam latch of FIG. 16 removed from the nest.

FIGS. 20 and 21 show the front latch end and rear ends of latch 41 removed from the nest 50.

Figure 22:
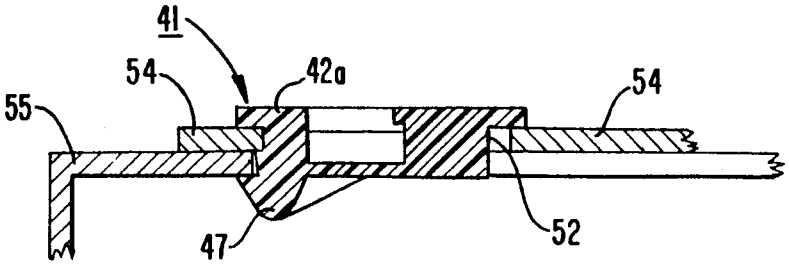
FIG. 22 is a longitudinal sectional view of the slam latch of FIG. 16 in normally-closed position in the nest of FIG. 23.
Figure 25:
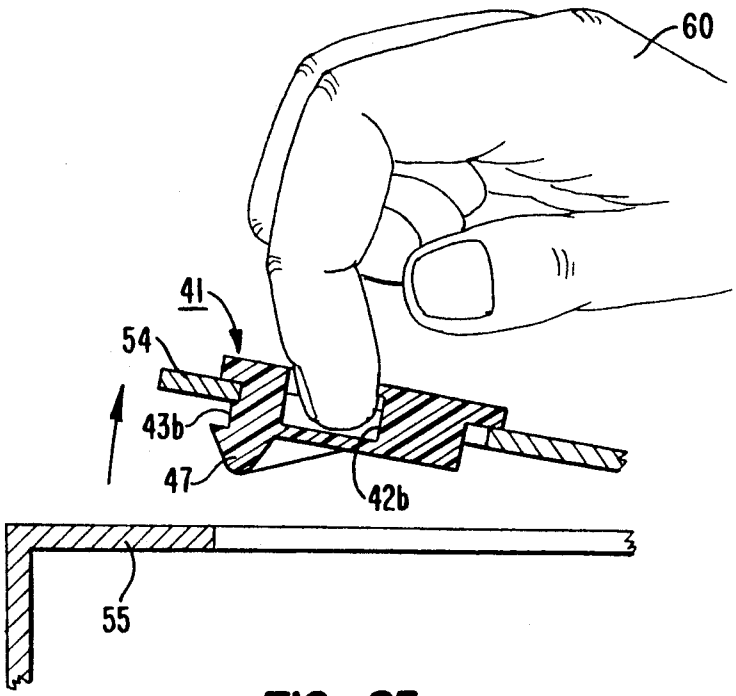
FIG. 25 is a longitudinal partial sectional view of the slam latch of FIG. 16 in the constricted nest of FIG. 23 being raised by finger contact.
Figure 24:
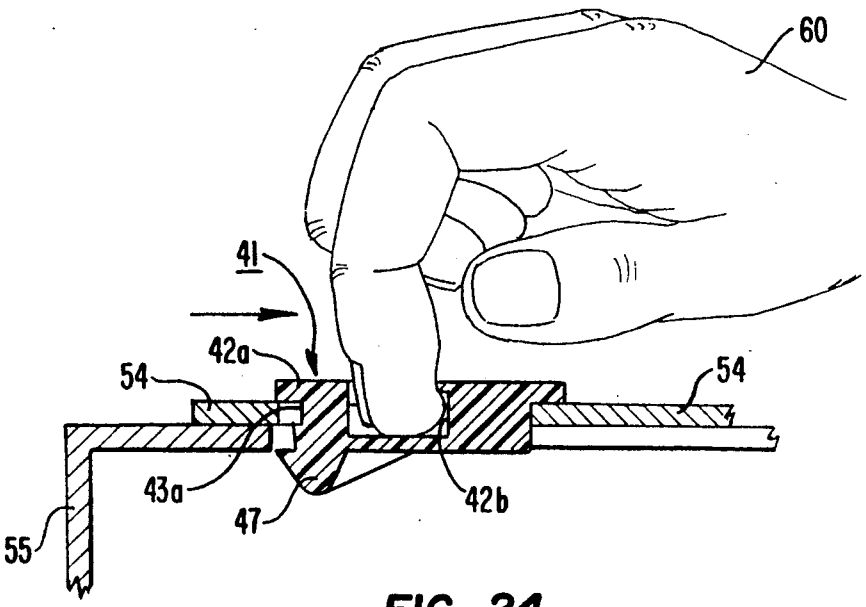
FIG. 24 is a longitudinal partial sectional view of the slam latch of FIG. 16 in the constricted nest of FIG. 23 being retracted by finger contact.
Figure 27:
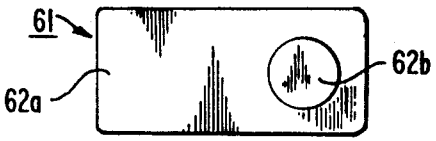
FIG. 27 is a top view of the slam latch of FIG. 26, removed from the nest of FIG. 23.
Figure 28:
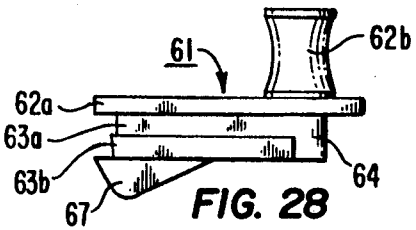
FIG. 28 is the side-elevation of the slam latch of FIG. 26 removed from the nest.
Figure 29:
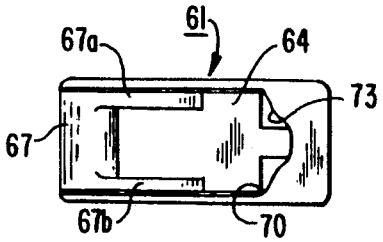
FIG. 29 is the bottom view of the slam latch of FIG. 26 removed from the nest of FIG. 23, wherein the spring has a rearwardly projecting end portion.
Figure 31:
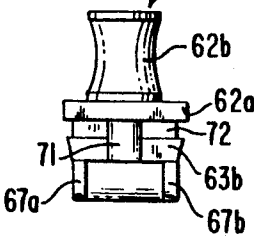
FIG. 31 is a rear-elevational view of the slam latch of FIG. 26 removed from the nest.
Figure 30:
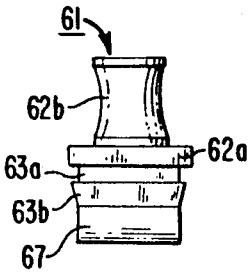
FIG. 30 is a front-elevational view of the slam latch of FIG. 26 removed from the nest of FIG. 23.

FIG. 22 is a longitudinal section through the center of latch 41 installed in the door panel 54, which is closed against the stationary panel 55.

Figure 23:
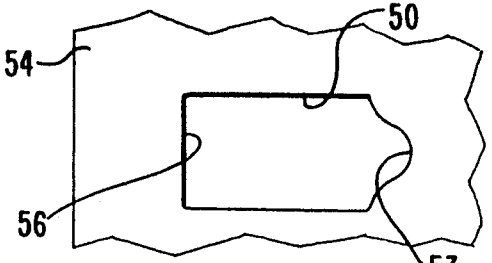
FIG. 23 shows the constricted metal nest of the slam latch of FIG. 16 with the latch removed.

FIG. 23 shows the constricted nest 50 of the latch 41 with the latch removed. The nest 50 is 1½ inches in overall length, and ¾ inch wide. The forward end wall 56 is straight across, being spaced about ⅜ inch from the forward end of the door panel 54. Centered in the inner end wall is a semicircular slot or constriction 53, having a radius of ¼ inch, and about ⅜ inch across at its base.

Referring to FIGS. 16–25, centered beneath the flat top layer **42*a* of latch 41, which is, say, ⅛ inch thick, is a second integral parallel layer 43*a* which is ⅛ inch along the side, ⅝ inch across, and ⅛ inch deep. Layer 43*a* is centered ¼ inch in from the forward under edge of 42*a*, providing a front margin of ¼ inch, and lateral margins of 1/16 inch on the lower surface of 42*a*. The end 52 opposite the latch lip 47, is rounded, extending out about ¼ inch in the center from the ends of the side walls. Below the layer 43*a* is another parallel layer 43*b*, which is 1 inch long, ⅝ inch wide, and ⅛ inch thick, which extends about 1/16 inch beyond the forward end of layer 43*a*, and at its rear end terminates in a central rectangular projection 51, which is 3/16 inch wide, 3/16 inch long, and ⅛ inch thick. The latch lip assembly comprising the latch lip 47, supported on opposite ends by a pair of integral supporting side walls 47*a* and 47*b*, projects down from the under surface of the layer 43*b*. The side arms 47*a* and 47*b*, which are flush with the sides of the under layer 43*b*, are each 3/32 inch thick, and substantially triangular in shape, forming an angle which extends downward 18 degrees from the horizontal, in a lengthwise direction. The sidewalls 47*a*, 47*b* extend along each side from a plane ⅜ in from the inner ends of the sides of under layer 43*b*, a total distance ⅞ inch, terminating in the flat upper surface of latch lip 47, which projects out ⅛ inch from the forward end of the under layer 43*b*, forming a sharp edge. The latch lip 47 extends ⅜ inch below the bottom of the under layer 43*b*, forming an angle between its front face and the vertical plane of about 35 degrees. The lip 47 is rounded across its lower end, forming a cam-like contacting surface which, when the door 54 is slammed, engages and moves slideably over the edge 55, causing it to snap into the slot between the upper surface of lip 47 and the under surface of the door panel 54. This assumes the latch 41 has been seated in the groove surrounding layer 43*a*, formed between the under surface of layer 42*a*, and the upper surface of layer 43*b***.

The latch action will be better understood by reference to my application Ser. No. 60,933, filed Jun. 9, 1987, jointly with James A. Jason, entitled Resilient Latching Device, which is incorporated herein by reference, and which will issue on Apr. 17, 1990 as U.S. Pat. No. 4,917,413.

Referring to FIGS. 26–34, there is shown a modification of the slam latch shown and described with reference to latch 41 of FIGS. 16–25. It will be noted that 20 digits have been added to the designating numbers of the former figures, and unless otherwise indicated, the description of correspondingly numbered items will be the same with reference to the two sets of figures indicated.

Figure 26:
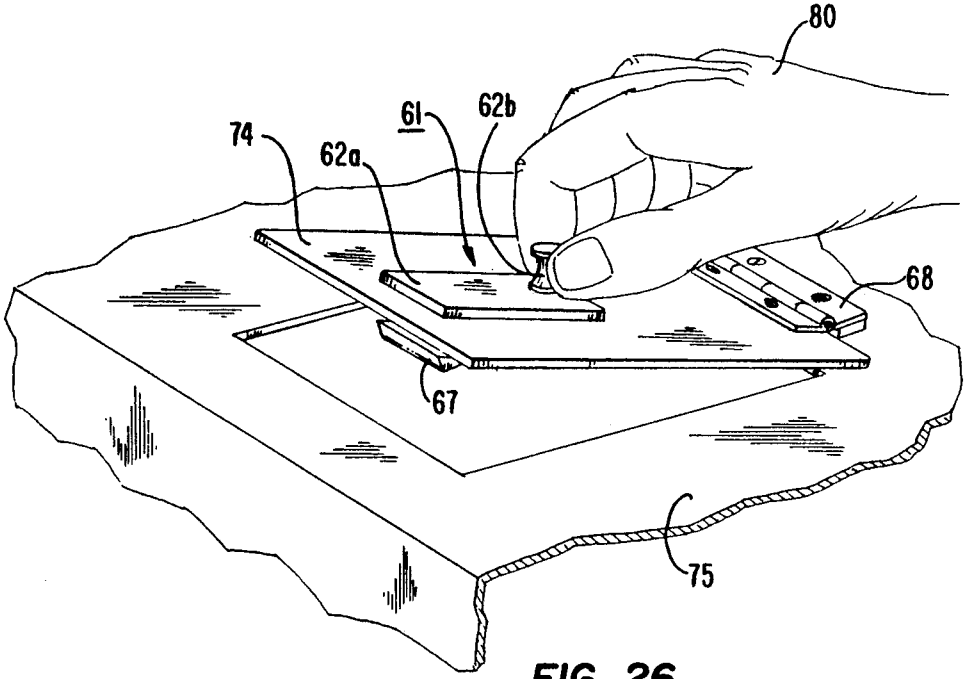
FIG. 26 is a perspective showing of another modification of the slam latch of my invention mounted in a constricted nest of the form of FIG. 23 being raised by thumb-finger contact with a knob.
Figure 32:
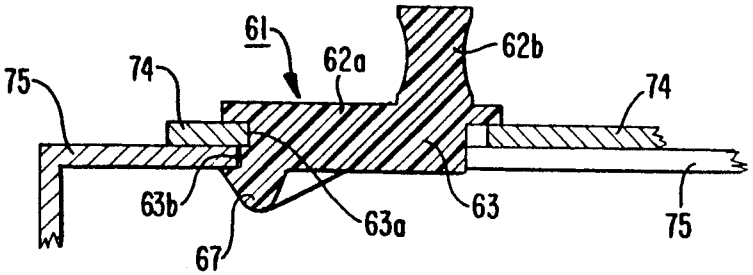
FIG. 32 is a longitudinal sectional view of the slam latch of FIG. 26 in normally-closed position in the nest of the form of FIG. 23.
Figure 34:
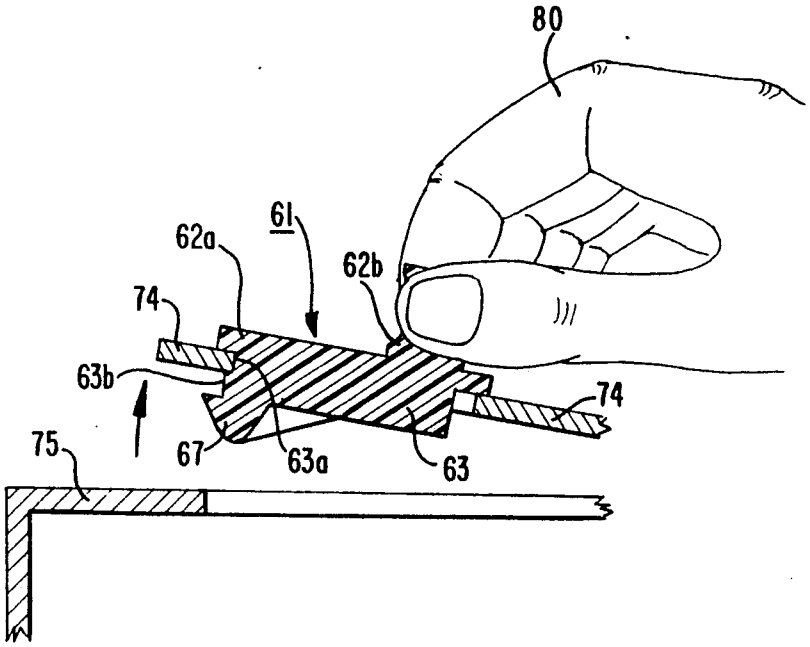
FIG. 34 is a partial sectional view of the slam latch of FIG. 26 being manually raised from the nest of FIG. 23.
Figure 33:
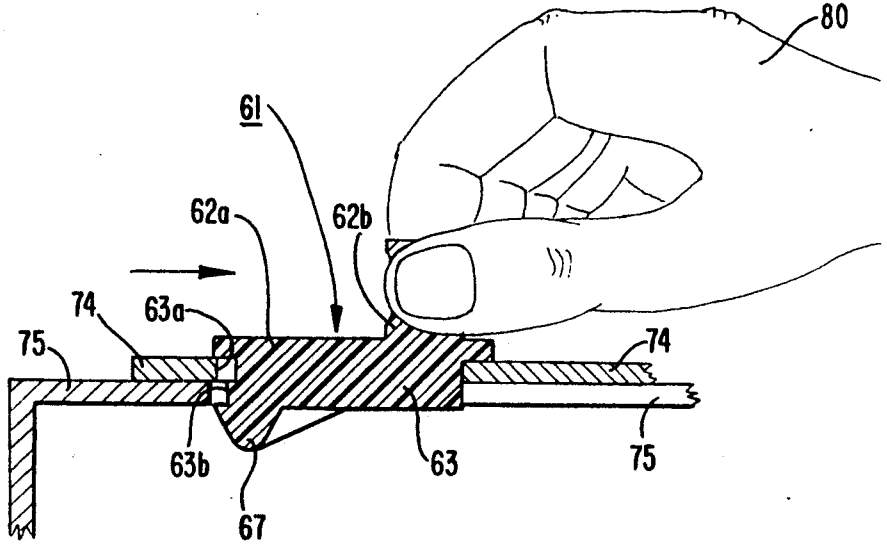
FIG. 33 is a partial sectional view of the slam latch of FIG. 26 being manually retracted in the constriction in the nest of FIG. 23.
Figure 36:
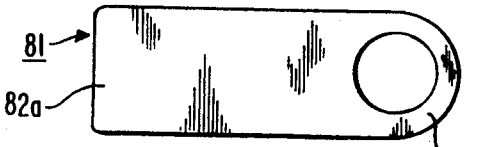
FIG. 36 is a top view of the slam latch of FIG. 35 removed from the nest of FIG. 23.
Figure 37:
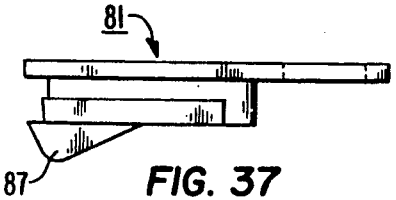
FIG. 37 is a side-elevational view of the slam latch of FIG. 35 removed from the nest.
Figure 38:
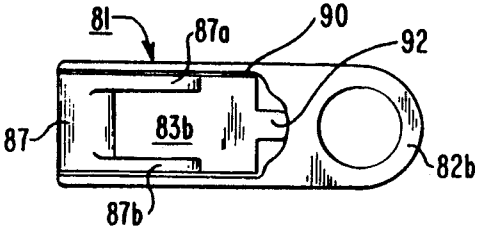
FIG. 38 is a bottom view of the slam latch of FIG. 35 removed from the nest, wherein the spring comprises a rearwardly projecting end portion.
Figure 40:
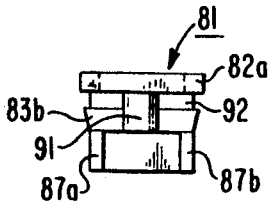
FIG. 40 is a rear-elevational view of the slam latch of FIG. 35 removed from the nest.
Figure 39:
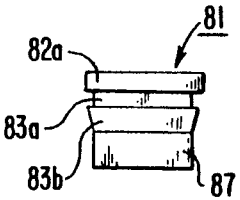
FIG. 39 is a front end-elevational view of the slam latch of FIG. 35 removed from the nest of FIG. 23.
Figure 35:
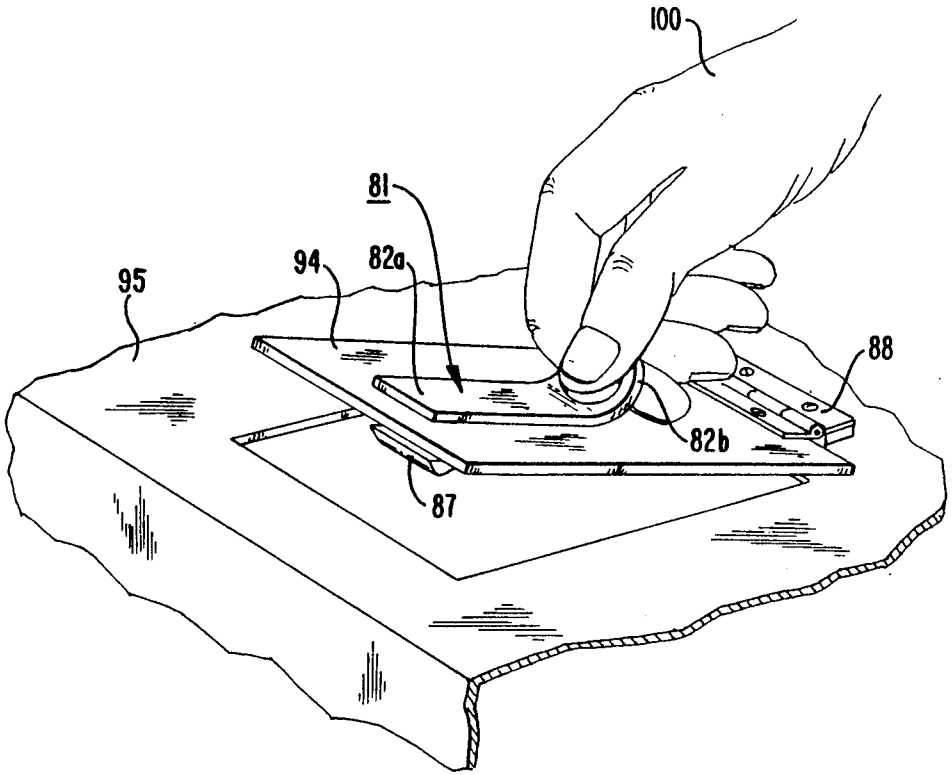
FIG. 35 is a perspective showing of another modification of the slam latch of my invention mounted in a constricted nest of the form of FIG. 23 having a cut out tab for grasping.

Instead of the recess **42*b*, shown and described with reference to the embodiment of FIGS. 16–25, a knob 62*b* has been substituted in the embodiment of FIGS. 26–34, which, to open the latch, is grasped between the thumb and fingers of the hand 80 of the user, as shown in perspective in FIG. 26**.

FIGS. 27 through 31 show the latch 61, in top view, side elevation, bottom view, forward and rear end views, respectively, removed from the nest. The latter constricted nest is indentical to the nest 50 described in detail with reference to FIG. 23, hereinbefore.

The knob **62*b* is of general cylindrical shape, except that the side walls are slightly concave to accommodate the thumb and fingers of the user. In the present illustrative embodiment, the knob 62*b* is, say, ½ inch in diameter and ½ inch high, and centered on the upper surface of the top layer 62*a*** about ½ inch in from the rear end.

It will be understood that except as otherwise indicated, as to the finger manipulation, the structure and operation of the latch 61, as shown in FIGS. 26–34 is substantially the same as that shown and described with reference to latch 41 in FIGS. 22–25.

A further modification of the slam latch 41 is shown in FIGS. 35–45 of the drawings, in which still a different device is provided for opening the latch by substituting a loop-shaped tab for the finger-hold depression **42*b*, or the knob 62*b*, respectively employed in latches 41 and 61. As in the previous embodiment, 40 digits have been added to the designations used with reference to latch 41**; and it will be understood, that unless otherwise indicated, correspondingly numbered items are as previously described.

Referring to FIGS. 35–43, the finger-hold depression **42*b* of latch 41 and the knob 62*b* of latch 61 are replaced in latch 81 with a ring-shaped tab 82*b*. The latter comprises a circular opening, say, ½ inch in diameter, centered, say, ¾ inch in from the rear edge. The rear half of 82*b* is rounded to conform to the shape of the opening, providing a flat ring, the rear margin of which is about ¼ inch wide, which is integrally attached to the top layer 82*a*, as shown in FIGS. 35–43**.

It will be understood that this latch 81 is seated in a constricted nest cut into a door panel 94, which is substantially similar to that shown in FIG. 23; and that the latch portions, including latch lip 87 are structured and function in a manner similar to latches 41 and 61, previously described.

Figure 45:
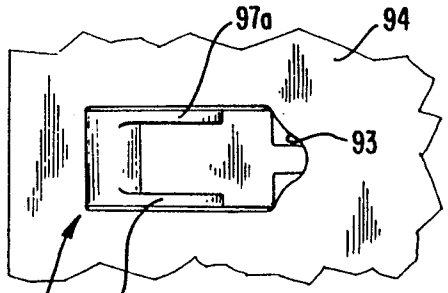
FIG. 45 shows a bottom view of the slam latch of FIG. 35 wherein the spring has a rearwardly projecting end portion in retracted position in the constricted nest of FIG. 23.
Figure 41:
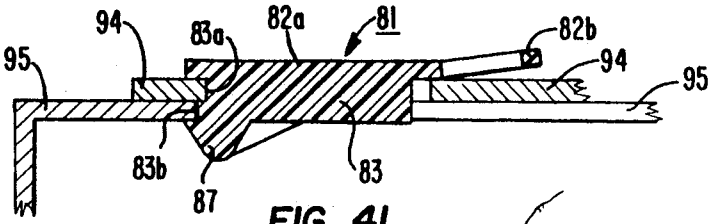
FIG. 41 is a longitudinal sectional view of the slam latch of FIG. 35 in normally-closed position in the nest of FIG. 23.
Figure 42:
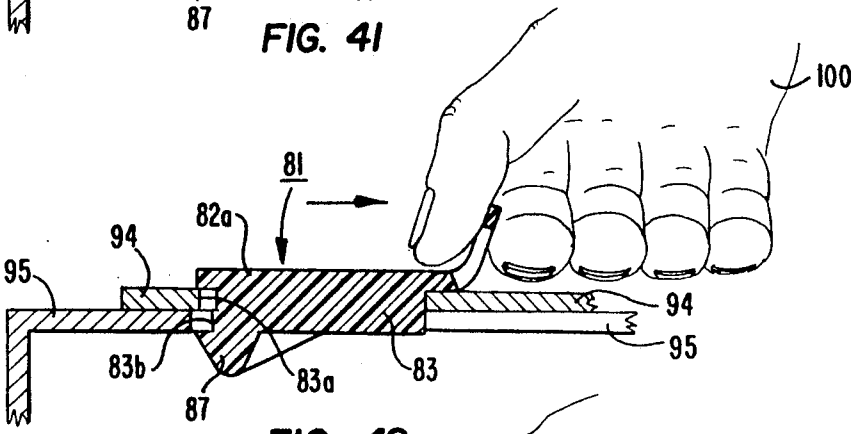
FIG. 42 is a longitudinal partial sectional view of the slam latch of FIG. 35 being retracted in the nest of FIG. 23.
Figure 43:
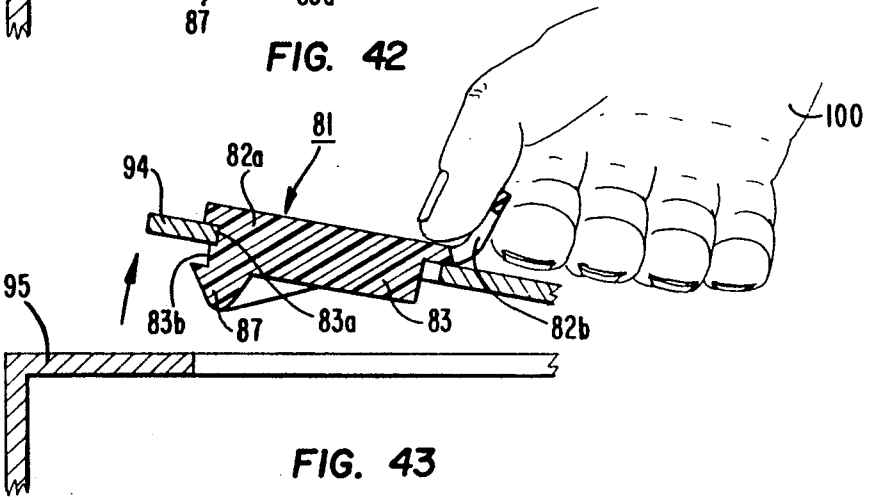
FIG. 43 is a longitudinal partial sectional view of the slam latch of FIG. 35 completely disengaged from the striker bar and being raised.
Figure 46:
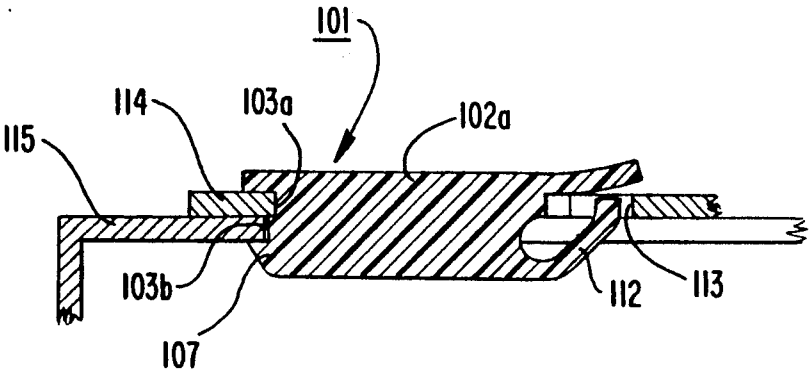
FIG. 46 shows in longitudinal section still another modification of the slam latch of the present invention in normally-closed condition in a constricted nest of the form of FIG. 23.

Referring to FIG. 46, there is shown another embodiment 101 of the slam latch invention described in the previous figures. It will be understood that twenty has been added to the designating numbers set forth in FIGS. 35–45, and unless otherwise described, correspondingly numbered elements are substantially similar in appearance and function.

Figure 47:
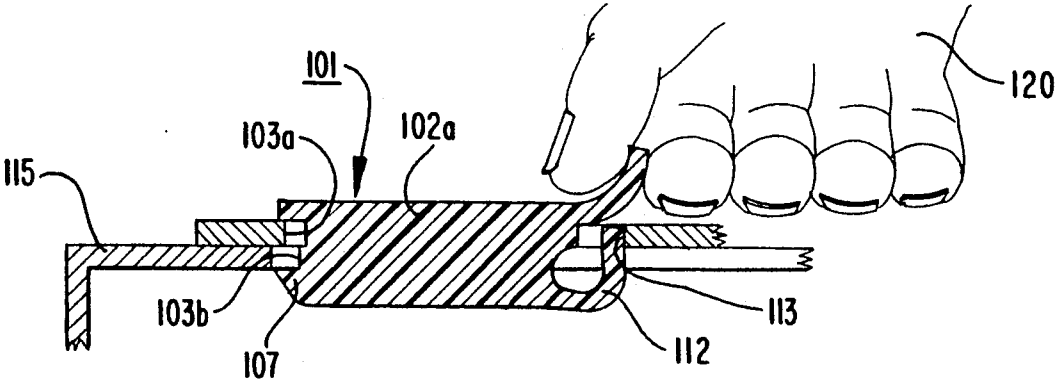
FIG. 47 shows in longitudinal section the slam latch of FIG. 46 displaced inwardly in the X-direction to open the latch mounted in the constricted nest of FIG. 23.

One of the principal differences is that the spring element 92 in the embodiment 91 is replaced in the embodiment of FIGS. 46 and 47 with a flat rectangular lip or flap 112, extending across the width of the latch, normal to the plane of the drawing, which is, say, 1/10 inch thick, and forms, say, a 45 degree angle with the principal plane of the latch, extending upward and rearward, say, ⅜ inch along the bias from the base of the latch.

In the normally-closed condition, as shown in FIG. 46, the rear edge of the lip 112 is slightly spaced-apart from the rear edge 113 of the nest, which in the present embodiment may have a shape similar to that shown in FIG. 23, hereinbefore.

When the body of the latch is grasped and moved inward in the direction of the arrow, causing the latching lip 107 to disengage from the striker bar 115 as shown in FIG. 47, the lip 112 contacts and is bent backward against the edge of the lip 113, providing a spring-bias. This propels the latch body forward in the opposite direction when the grasping contact is released.

Figure 48:
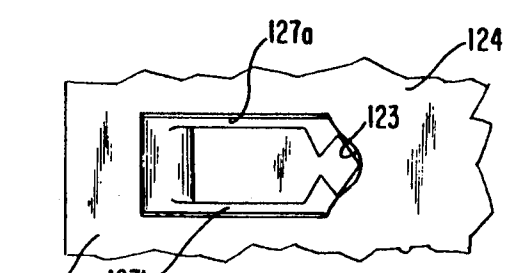
FIG. 48 shows the bottom view of a modification of the slam latch of the present invention mounted in the constricted nest of FIG. 23 wherein the spring is diamond-shaped centered on the principal longitudinal axis of the body of the latch, with the laterally-extended points directed in opposite directions normal to the principal axis of the latch body.
Figure 44:
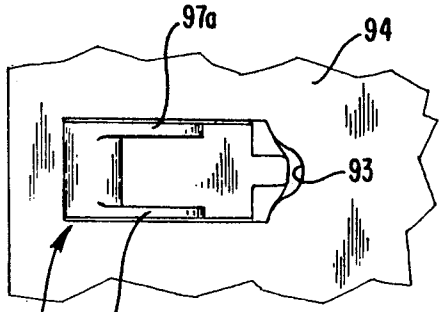
FIG. 44 shows a bottom view of the slam latch of FIG. 35 wherein the spring comprises a rearwardly projecting end portion in normally-closed position in the nest of FIG. 23.

FIG. 48 shows a further modification of the slam latch of the present invention in which the spring member 93 of FIGS. 44 and 45 is replaced by a diamond-shaped spring member 123 centered on the principal longitudinal axis of the latch body 127; with laterally-extended points directed in opposite directions normal to the principal axis of latch body 127.

Figure 49:
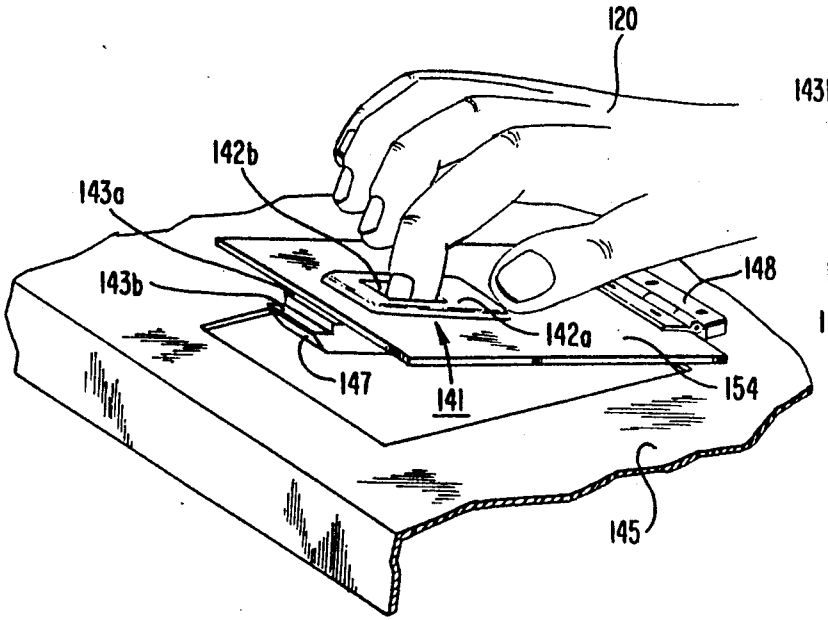
FIG. 49 shows in perspective a preferred modified embodiment of the slam latch of the present invention wherein a spring member in the form of an inwardly-projecting cantilever finger is compressed against the edge of a rectangular nest.

FIG. 49 shows a preferred embodiment of the slam latch of the present invention which, instead of a nest of the form of FIGS. 10 or 23 having a constricted portion at the end opposite the latch lip, is a rectangular opening 10 in plate 145 having four straight edges, as shownin FIG. 10.

Parts of the embodiment of FIG. 49 are similar to the finger-operated latch shown in FIGS. 16–25 hereinbefore. Accordingly, 100 has been added to the designating numbers of FIGS. 16–25, the descriptions of the parts being similar unless otherwise indicated.

FIG. 49 is a perspective showing of the finger-actuated latch 141 intalled on a door panel 154 which is connected by a hinge 148 to one edge of the rectangular opening 150 having four straight edges. The latch 141 is shown being retracted by a finger from a hand 160 of a user. The finger is inserted into a recess **142*b*, located, say, 5/16 inch from the forward end of the top layer 142*a*. Recess 142*b* may be centered, roughly square for example, extending say, ⅞ inch on each side, and say, ½ inch deep, and shaped to accommodate the finger. The top layer 142*a* of latch 141** is rectangular, say, about 1¾ inch long and 1 inch wide, and 1/16 inch thick.

Figure 51:
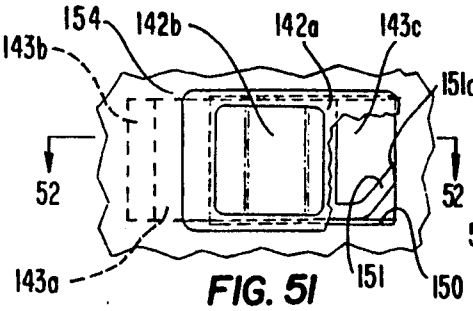
FIG. 51 is a view of the latch of FIG. 49 mounted in the rectangular nest of FIG. 50 with the top layer partially broken away to show the inwardly-projecting cantilever finger in its normally closed latched position in the rectangular nest of FIG. 50.

A top view of latch 141 in its latched or operated position, in the nest 150, is shown in FIG. 51 with the rear portion of the top layer **142*a* partially broken away to show the slot 143*c* and the cantilever spring element 151** in rest position, as will be explained hereinafter.

Figure 52:
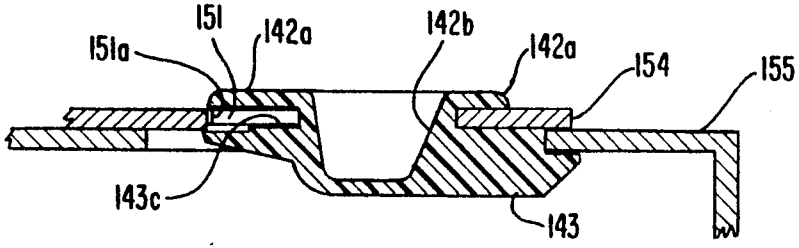
FIG. 52 shows a longitudinal section through the plane indicated by the arrows 52—52 of FIG. 51.
Figure 55:
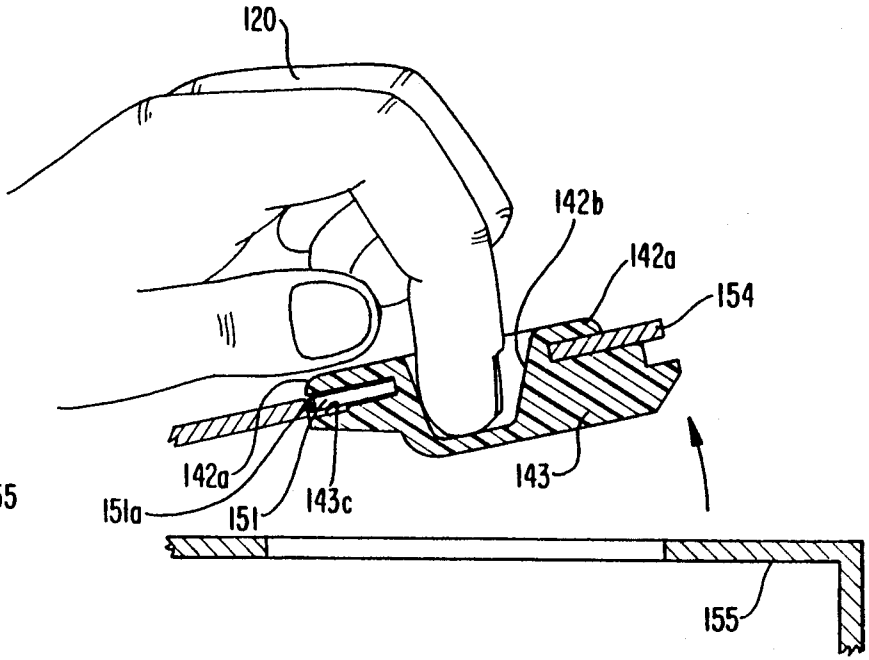
FIG. 55 shows a sectional view of the slam latch of FIG. 49 completely disengaged from the striker bar and lifted up.

FIG. 52 is a longitudinal section of the latch in operated position, as shown in FIG. 51, through the plane indicated by the arrows of 52—52.

Figure 53:
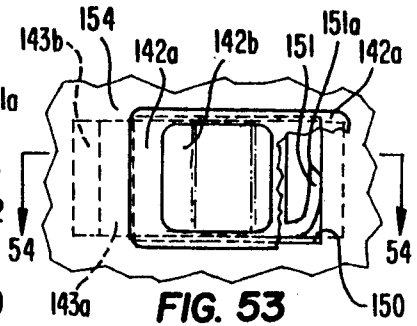
FIG. 53 is a view of the latch of FIG. 49 with the top layer partially broken away to show the inwardly-projecting cantilever finger in its retracted position against the edge of the rectangular nest of FIG. 50.

FIG. 53 is a top view of latch 141 in retracted position, in the nest 150, with the top layer **142*a* with the rear portion of layer 142*a* partially broken away to show the cantilever spring 151 in bent position squeezed against the straight edge of the nest 151**.

Figure 59:
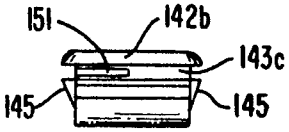
FIG. 59 is a rear-elevational view of the slam latch of FIG. 49 removed from the nest.
Figure 60:
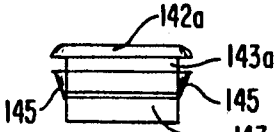
FIG. 60 is a front-elevational view of the slam latch of FIG. 49 removed from the nest.
Figure 56:
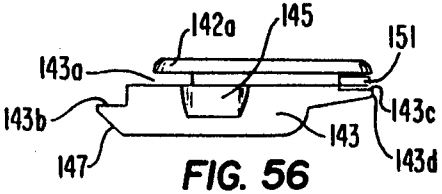
FIG. 56 shows a side-elevational view of one side of the slam latch of FIG. 51 removed from the nest of FIG. 50.
Figure 57:
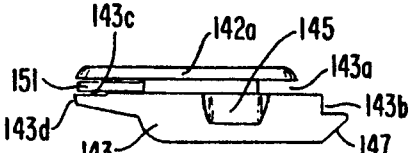
FIG. 57 shows a side-elevational view of the other side of the slam latch of FIG. 51 removed from the nest of FIG. 50.
Figure 58:
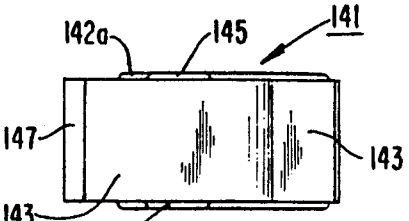
FIG. 58 is the bottom view of the slam latch of FIG. 49 removed from the nest of FIG. 50.
Figure 50:
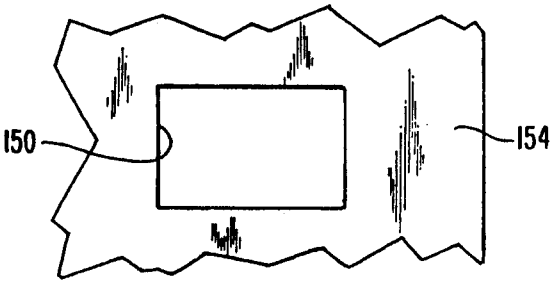
FIG. 50 shows the rectangular nest with the latch removed.

FIGS. 56 and 57 show the two side elevations of latch 141 removed from the nest 150. FIG. 58 shows the bottom of latch 141 removed from nest 150; and FIGS. 59 and 60 show end elevations of the front and rear of the latch 141 removed from the nest 150.

Referring to FIGS. 51–60, the body portion 143 of latch 141 is, for example, 2¼ inches in overall length, and 1 inch across the width, and extends overall to a depth of, say, ½ inch below the lower surface of the top layer **142*a*, which extends, say, 1/16 inch beyond the lateral surfaces of the body portion 143**.

As in the previously described embodiments in FIGS. 1–48 of this application, the foreward end of the latch 141 terminates in a latch lip 147, which projects out from the base at an angle of say, 45 degrees forming on its upper surface a step **143*b*, say ⅜ inch wide which extends, say, 1 inch across the width of the body 143. This forms a latch which is constructed to engage the foreward edge or striker bar of the rectangular opening in the plate 143 as disclosed in FIGS. 1–48** herein, and as disclosed and claimed in my U.S. patent application Ser. No. 222,086, filed Jul. 20, 1988.

The step **143*b* terminates in a second step which rises vertically, say, ⅛ inch to a flat surface 143*a* which extends inwardly say, ½ inch, forming a slot ¼ inch deep with the lower surface of the upper plate 142*a***.

Three-eighths of an inch in from the outer edge of the step **143*a* and say 1 inch in from the other end of body 143, on opposite lateral walls extending down say, ¼ inch, from the upper surface 143*a* at a small angle of say, 12°, are a pair of bosses 145, having flat upper surfaces, say, 1/32 inch wide and ½ inch long, which serve to secure the latch body 143 in slideable longitudinal relation, serving as tracks for the foreward and backward motion of the latch 141 against the edges of the nest opening 150 when the latch is installed in the plate 154**.

About 1⅜ inch inward along the base of the body 143 from the angle forming the lip 147, the body curves upward at a radius curvature of say, ⅜ inch, forming a semicylindrical portion extending across the width of the body 143, from which projects a tapered flange **143*d*, a longitudinal distance of about ½ inch, forming a small upward angle of say, 12° with the horizontal. The tapered flange 143*d* terminates in a bevelled edge about 1/16 inch thick which is substantially flush with and coextensive with the inner edge of the top plate 143*a*. The under surface of top plate 143*a* and the top surface of flange 143*d* forms, running the length between them, a slot 143*c***, which extends say, ¼ inch in a longitudinal direction and is say, 3/32 inch deep in a vertical direction.

As shown in the cut-away portion of FIG. 51, a particular feature of the present embodiment is a curved spring member 151 in the form of a finger, say 1/16 thick, which is housed to move slideably in a lateral plane in the slot **143*c*, being rooted with one end attached to the inner end of the slot, near one corner, and being curved inwardly therefrom in cantilever fashion, through nearly 90° , the free terminal 151*a* , which is about ⅛ inch wide and 1/16 inch thick, projecting freely about 1/16 beyond the rear edge of the slot 143*c*, in its rest position, when the latch 141 is mounted in slideable relation, in latched position in the opening 150**.

Figure 54:
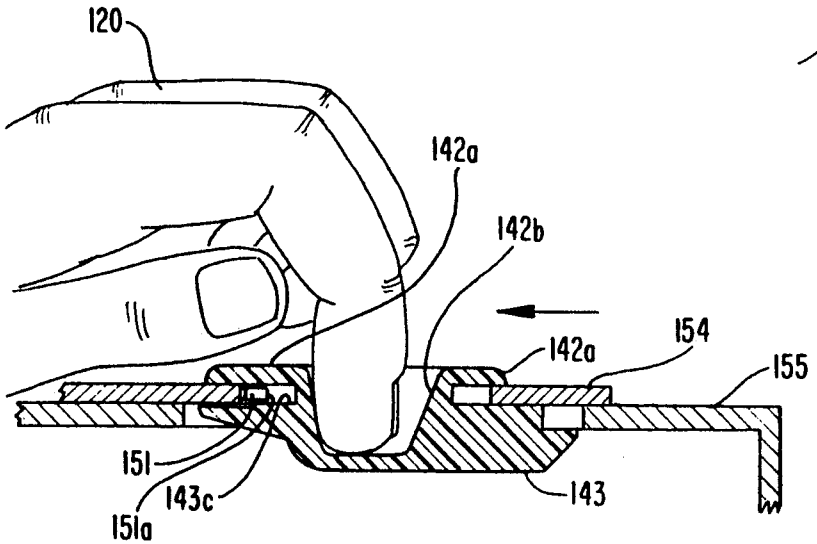
FIG. 54 shows a longitudinal section through the plane indicated by the arrows 54—54 of FIG. 53, with the fingers of the user added.
Figure 62:
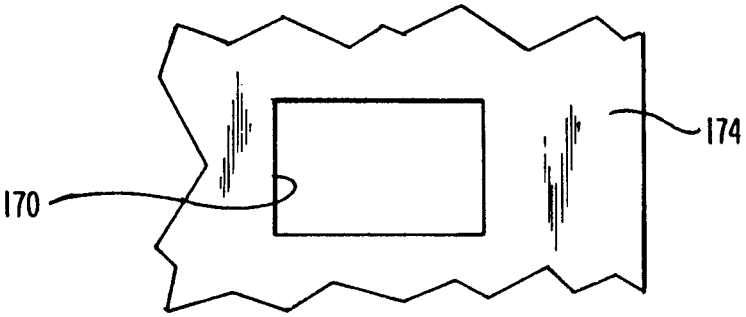
FIG. 62 shows the rectangular nest with the latch removed.

When the latch 141 is retracted from its latched position, as illustrated in FIGS. 53 and 54, the terminal **151*a* is squeezed against the rear edge of the rectangular opening 150, the cantilever finger forming a substantially greater curvature, and producing a spring bias between the nest 150 and the latch. This bias tends to force the latch foreward in the plane of plate 154, causing the latch lip 147 to reengage the outer edge or striker bar of the opening in the plate 145**.

In another embodiment shown removed from the nest in FIG. 61, of the drawings, a tool 176 (see FIGS. 72 and 73) is designed to actuate the latch 161 instead of finger actuation, as employed with the embodiment of FIG. 49. It will be understood that parts of the embodiment of FIG. 61 are similar to the finger-operated latch shown in FIGS. 49–60. Accordingly, 20 has been added to the designating numbers of FIGS. 49–60, the descriptions of the parts being similar unless otherwise indicated.

FIG. 61 is a perspective showing of the tool-actuated slam latch 161 with the nest partially broken away. The latch 161 is designed for operation by a tool 176 as shown in FIGS. 72 and 73 in the hand of the user. It is contemplated that the tool 176 may take the form shown in FIGS. 72 and 73, having a cylindrical handle, say, ¾ inches in diameter and, say, 2½ or 3 inches on its long axis and having one or more projecting prongs 176*a*, 176*b*, say, ⅛ in diameter, which are symmetrically disposed, say, centered ¼ inch apart to extend, say, 1 inch in an axial direction from the lower end face of the tool. The terminal ends of prongs 176*a* and 176*b* may be shaped in the form of keys which are adapted to engage and lock into two small round key openings 177*a* and 177*b*, say, just exceeding ⅛ inch in diameter, which are punched through the thickness of the upper plate 162*a*. (See FIGS. 63, 64 and 65.) It will be noted that the positioning of the key openings 177*a* and 177*b*, in aligned, spaced-apart relation near the left-hand inner corner of the plate 162*a*, is designed to avoid interference with cantilever spring 171, so that when the latter is moved from its extended position, as shown in FIG. 63, to its depressed position, as shown in FIG. 65, it is not impeded by the prongs 176*a* or 176*b*, which are locked in a vertically upright position to the surface of 162*a*. Whereas, the tool 176 has been disclosed, by way of example, as having two prongs, and as having terminals which key into the openings 177*a* and 177*b*, it will be understood that this arrangement could be modified to have a single opening which would accommodate a different type of tool, say a conventional screw-driver.

Referring to FIGS. 63–71, the body portion 163 of latch 161 is, for example, similarly dimensioned to the embodiment described with reference to FIGS. 51–60.

As in the previously described embodiments in FIGS. 1–48 et seq. of this application, the foreward end of the latch 161 terminates in a latch lip 167, which projects out from the base at an angle of say, 45 degrees forming on its upper surface a step 163*b* dimensioned as in the previously described embodiments. This forms a latch which is constructed to engage the foreward edge or striker bar of the rectangular opening in the plate 175 in the manner disclosed in FIGS. 1–48 et seq. herein, and as disclosed and claimed in applicant's U.S. patent application Ser. No. 222,086, filed Jul. 20, 1988.

The step 163*b* terminates in a second step which rises vertically, to a flat surface 163*a* which extends inwardly forming a slot with the lower surface of the upper plate 162*a*, the shape and dimensions being similar to those previously described.

As in the earlier described embodiment, a pair of lateral bosses, such as 165 having flat upper surfaces serve to secure the latch body 163 in slideable longitudinal relation, for the foreward and backward motion of the latch 161 against the edges of nest opening 170 when the latch is installed in plate 174. The shapes and dimensions of these are similar to those previously described.

Directed inwardly along the base of the body 163 from the lip 167, the body is flat on the bottom and then curves upward, forming a semicylindrical portion extending across the width of the body 163, from which projects a tapered flange 163*d*, forming a small upward angle with the horizontal. The tapered flange 163*d* terminates in a bevelled edge which is substantially flush with and coextensive with the inner edge of the top plate 163. The under surface of top plate 163 and the top surface of flange 163*d* form, running the width between them, a slot 163*c* and the shape and dimensions being as previously described.

The curved spring member, in the form of a finger, as described in the previous embodiment, is numbered 171 in the embodiment of FIG. 63, of which the shape and dimensions are the same as in the embodiment described earlier with reference to FIG. 51. Spring member 171 is housed to move slideably in a lateral plane in the slot 163*c*, being rooted with one end attached to the inner end of the slot 163*c*, near one corner of flange 163*d*, and being curved inwardly therefrom in cantilever fashion, through nearly 90 degrees, the free terminal 171*a*, projecting just beyond the rear edge of the slot 163*c*, in its rest position, shown in FIGS. 63 and 63, when the latch 161 is mounted in slideable relation, in latched position in the opening 170. Thus, the finger 171 is positioned so that its motion is not interfered with when the tool 176 is in place in the keyholes 177*a*, 177*b*.

A top view of latch 161, in its latched or operated position in the nest 170, is shown in FIG. 63 with the tool 176 removed from the key openings 177*a* and 177*b*, the rear portions of the top layer 162*a* partially broken away to show the upper face of flange 163*d* in slot 163*c* beneath and parallel to top plate 162*a*, with the cantilever spring element 171 in rest position, as in the previous embodiments described with reference to FIG. 49 et seq.

Figure 64:
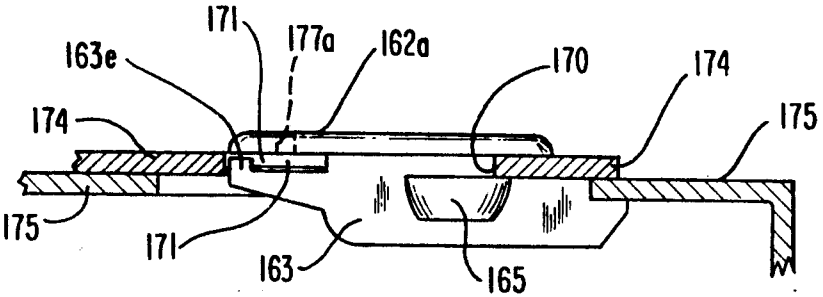
FIG. 64 shows a longitudinal section through the plane indicated by the arrows 64—64 of FIG. 63, of the latch in closed, latched position.

FIG. 64 is a longitudinal section of the latch in operated position, as shown in FIG. 63, through the plane indicated by the arrows 64—64 of FIG. 63.

Immediately adjacent the outer corner edge on the upper face of flange 163*d*, in the slot 163*c* on the side opposite spring member 171, is a small rectangular boss 163*e*, say ¼ inch long and ¼ inch wide and ⅛ inch thick. This may be rectangular, or alternatively other suitable shapes, such as semicylindrical.

Figure 66:
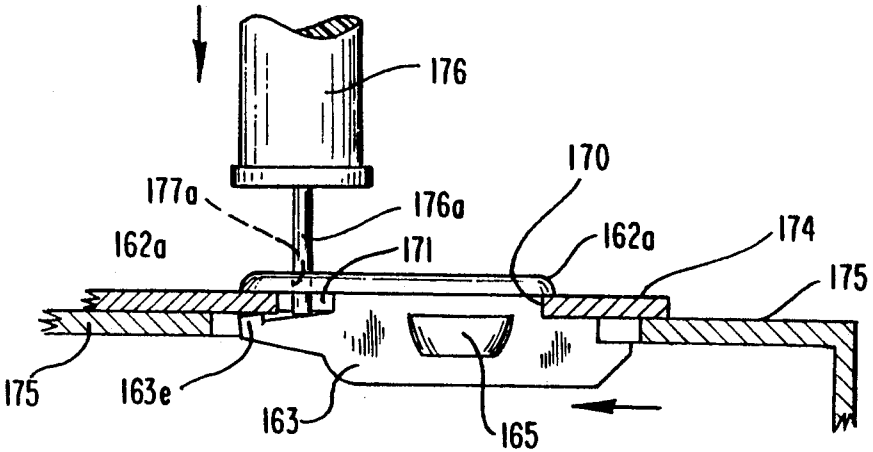
FIG. 66 shows a longitudinal section through the plane indicated by the arrows 66—66 of FIG. 65, with the tool of the user added.

When the latch 161 is retracted from its latched position, byuse of the tool 176, as illustrated in FIGS. 65 and 66, the terminal of 171*a* is squeezed against the rear edge of the rectangular opening 170, the cantilever finger forming a substantially greater curvature, and producing a spring bias between the nest 170 and the latch. When the tool 176 is removed, this bias tends to force the latch foreward in the plane of plate 174, causing the latch lip 167 to re-engage the outer edge or striker bar of the opening in the plate 165.

FIG. 65 is a top view of latch 161 in retracted position, in the nest 170, when the tool 176 is in place in locking position in the keyholes 177*a*, 177*b*, and with the rear portion of the top layer 162*a* partially broken away to show the cantilever spring 171 in bent position squeezed against the straight edge of the nest 171. This is also shown in section in FIG. 66. Simultaneously, the small boss 163*e* is forced beneath the lower surface of top plate 174, holding the body 163, by its frictional contact in its retracted, unlatched position.

FIGS. 67 and 68 show the two side elevations of latch 161 removed from nest 170; and FIGS. 70 and 71 show end elevations of the front and rear of the latch 161 removed from the nest 170. FIG. 69 is the bottom view of the latch 161.

Thus, using the tool 176, the operator opens the latch from the locked position shown in FIGS. 63 and 64 and places the latch in open position as shown in FIGS. 65 and 66.

It will be understood that the latch 161 can be used with the tool 176, with or without a finger hole, as shown in previous embodiments.

Although the invention has been described in detail with reference to specific embodiments, it will be understood that this invention is not limited to the specific forms and dimensions shown by way of illustration, but only by the scope of the appended claims.

What is claimed is:

1. A snap action latching combination comprising elements for installation adjacent the edge of a first door or panel for alternatively maintaining the edge of said first door or panel in spaced-apart open position or in tightly latched abutting position with reference to a striker bar at the edge of a second door or panel, which combination comprises:

a unitary solid body of elastomeric material installed in a nest adjacent the edge of said first door or panel, said unitary body characterized by a principal plane which, upon installation, is substantially parallel to the principal plane of the surface of said first door or panel, said unitary body having at least one latch lip which protrudes outwardly from the edge of said body in a direction both parallel to and normal to said principal plane, said latch lip being stepped back on an inwardly-directed upper surface to form a catch which just accommodates the thickness of said striker bar, the outwardly-directed under surface of said latch lip comprising a protuberance for elastically-deformable engagement with said striker bar;

said nest comprising an opening cut into the surface of said first door or panel for accommodating said body in laterally slideable relation in a plane parallel to said principal plane and in a direction substantially normal to the edge of said first door or panel;

said unitary body having one or more lateral edge slots or grooves for engaging the edges of said nest in said slideable relation;

said body terminating at the end opposite said latch lip in an integrally formed elastomer spring member, the edge of which is extended in said principal plane in a direction opposite to the direction of extent of said latch lip;

the opening comprising said nest having a first forward end for accommodating said latch lip in depending relation therefrom, and a rigid edge at the end of said nest opposite to said latch lip;

the principal plane of said body comprising manually-actuable means for sliding said body longitudinally in said opening from a first normal latching position at the forward end of said nest in which said latch lip is positioned for engagement with said striker bar, to a second retracted position for releasing engagement of said latch lip with said striker bar, and wherein said elastomer spring member at said opposite end is simultaneously deformed by being compressed against said rigid edge opposite said latch lip, thereby imposing a spring-bias on said body, the principal component of which is directed in said principal plane in the direction of said latch lip;

whereby the release of said manually-actuable means causes said body to slide in the opposite direction in said nest, returning to its first normal latching position, in which position said latch lip is constructed to re-engage said striker bar upon impact of said striker bar;

wherein said opening comprising said nest includes a constriction in said rigid edge opposite said latch lip, wherein in said second retracted position said spring member is deformed by being compressed against the walls of said constriction, thereby imposing a spring bias on said body;

and wherein said integrally formed elastomer spring member is diamond-shaped, centered on the principal longitudinal axis of said body, with the laterally extended points directed in opposite directions normal to said axis.

2. A snap action latching combination comprising elements for installation adjacent the edge of a first door or panel for alternatively maintaining the edge of said first door or panel in spaced-apart open position or in tightly latched abutting position with reference to a striker bar at the edge of a second door or panel, which combination comprises:

a unitary solid body of elastomeric material installed in a nest adjacent the edge of said first door or panel, said unitary body characterized by a principal plane which, upon installation, is substantially parallel to the principal plane of the surface of said first door or panel, said unitary body having at least one latch lip which protrudes outwardly from the edge of said body in a direction both parallel to and normal to said principal plane, said latch lip being stepped back on an inwardly-directed upper surface to form a catch which just accommodates the thickness of said striker bar, the outwardly-directed under surface of said latch lip comprising a protuberance for elastically-deformable engagement with said striker bar;

said nest comprising an opening cut into the surface of said first door or panel for accommodating said body in laterally slideable relation in a plane parallel to said principal plane and in a direction substantially normal to the edge of said first door or panel;

said unitary body having one or more lateral edge slots or grooves for engaging the edges of said nest in said slideable relation;

said body terminating at the end opposite said latch lip in an integrally formed elastomer spring member, the edge of which is extended in said principal plane in a direction opposite to the direction of extent of said latch lip;

the opening comprising said nest having a first forward end for accommodating said latch lip in depending relation therefrom, and a rigid edge at the end of said nest opposite to said latch lip;

the principal plane of said body comprising manually-actuable means for sliding said body longitudinally in said opening from a first normal latching position at the forward end of said nest in which said latch lip is positioned for engagement with said striker bar, to a second retracted position for releasing engagement of said latch lip with said striker bar, and wherein said elastomer spring member at said opposite end is simultaneously deformed by being compressed asgaint said rigid edge opposite said latch lip, thereby imposing a spring-bias on said body, the principal component of which is directed in said principal plane in the direction of said latch lip;

whereby the release of said manually-actuable means causes said body to slide in the opposite direction in said nest, returning to its first normal latching position, in which position said latch lip is constructed to re-engage said striker bar upon impact of said striker bar;

wherein said opening comprising said nest includes a constriction in said rigid edge opposite said latch lip, and wherein in said second retracted position said spring member is deformed by being compressed against the walls of said constriction, thereby imposing a spring bias on said body;

and wherein said integrally formed elastomer spring member is in the shape of a bar centered on the longitudinal axis of said body, and the ends being directed normal to said longitudinal axis.

3. A snap latching device for installation in or on a nest opening in a first door or panel for latching said door or panel to a striker bar on a second door or panel, said device comprising a unitary solid body of elastomeric material having a principal plane which, upon installation, is substantially parallel to the surface of said panel, said latching device having a latching lip which protrudes outwardly from the edge of said body in a direction both parallel to and normal to said principal plane, said lip stepped back on an inwardly-directed upper surface to form a catch which is constructed and arranged to just accommodate the thickness of said striker bar in latching relation, an outwardly-directed under surface of said latching lip comprising as protuberance for elastically-deformable engagement with said striker bar;

said body having one or more lateral edge slots or grooves substantially parallel to said principal plane for accommodating the edges of said opening, for installation of said body in said opening in laterally slideable relation in the direction of the principal longitudinal axis of said body;

said body terminating at the end opposite said latch lip in an integrally-formed elastomer spring member the edge of which is extended in said principal plane in a direction opposite to the direction of said latch lip;

the principal plane of said body comprising manually-actuable means for sliding said body longitudinally from a first normal latching position at the forward end of said opening in which said latch lip is positioned for engagement with said striker bar, to a second retracted position in which said latch lip is constructed to be released from engagement with said striker bar, and wherein said elastomer spring member at said opposite end is constructed to be simultaneously deformed by being compressed against an edge of said nest opening opposite said latch lip, thereby imposing a spring-bias on said body, at least a component of which is directed along in the direction of said latch lip;

said body being constructed so that release of said manually-actuable means releases said spring-bias, impelling said body to move slideably in the opposite direction in said nest opening;

wherein said integrally formed elastomer spring member is diamond-shaped, centered on the principal longitudinal axis of said body, with the laterally extended points directed in opposite directions normal to said axis.

4. A snap latching device for installation in or on a nest opening in a first door or panel for latching said door or panel to a striker bar on a second door or panel, said device comprising a unitary solid body of elastomeric material having a latching lip which protrudes outwardly from the edge of said body in a direction both parallel to and normal to said principal plane, said lip stepped back on an inwardly-directed upper surface to form a catch which is constructed and arranged to just accommodate the thickness of said striker bar in latching relation, an outwardly-directed under surface of said latching lip comprising a protuberance for elastically-deformable engagement with said striker bar;

said body having one or more lateral edge slots or grooves substantially parallel to said principal plane for accommodating the edges of said opening, for installation of said body in said opening in laterally slideable relation in the direction of the principal longitudinal axis of said body;

said body terminating at the end opposite said latch lip in an integrally-formed elastomer spring member the edge of which is extended in said principal plane in a direction opposite to the direction of said latch lip;

the principal plane of said body comprising manually-actuable means for sliding said body longitudinally from a first normal latching position at the forward end of said opening in which said latch lip is positioned for engagement with said striker bar, to a second retracted position in which said latch lip is constructed to be released from engagement with said striker bar, and wherein said elastomer spring member at said opposite end is constructed to be simultaneously deformed by being compressed against an edge of said nest opening opposite said latch lip, thereby imposing a spring-bias on said body, at least a component of which is directed along in the direction of said latch lip;

said body being constructed so that release of said manually-actuable means releases said spring-bias, impelling said body to move slideably in the opposite direction in said nest opening;

wherein said integrally formed elastomer spring member is in the shape of a bar centered on the longitudinal axis of said body, and the ends being directed normal to said longitudinal axis.

5. A snap action latching combination comprising elements for installation adjacent the edge of a first door or panel for alternatively maintaining the edge of said first door or panel in spaced-apart open position or in tightly latched abutting position with reference to a striker bar at the edge of a second door or panel, which combination comprises:

a unitary solid body of elastomeric material installed in a nest adjacent the edge of said first door or panel, said unitary body characterized by a principal plane which, upon installation, is substantially parallel to the principal plane of the surface of said first door or panel, said unitary body having at least one latch lip which protrudes outwardly from the edge of said body in a direction both parallel to and normal to said principal plane, said latch lip being stepped back on an inwardly-directed upper surface to form a catch which just accommodates the thickness of said striker bar, the outwardly-directed under surface of said latch lip comprising a protuberance for elastically-deformable engagement with said striker bar;

said nest comprising an opening cut into the surface of said first door or panel for accommodating said body in laterally slideable relation in a plane parallel to said principal plane and in a direction substantially normal to the edge of said first door or panel;

said unitary body having one or more lateral edge slots or grooves for engaging the edges of said nest in said slideable relation;

said body terminating at the end opposite said latch lip in an integrally formed elastomer spring member, the edge of which is extended in said principal plane in a direction opposite to the direction of, extent of said latch lip;

the opening comprising said nest having a first forward end for accommodating said latch lip in depending relation therefrom, and a rigid edge at the end of said nest opposite to said latch lip;

the principal plane of said body comprising manually-actuable means for sliding said body longitudinally in said opening from a first normal latching position at the forward end of said nest in which said latch lip is positioned for engagement with said striker bar, to a second retracted position for releasing engagement of said latch lip with said striker bar, and wherein said elastomer spring member at said opposite end is simultaneously deformed by being compressed against said rigid edge opposite said latch lip, thereby imposing a spring-bias on said body, the principl component of which is directed in said principal plane in the direction of said latch lip;

whereby the release of said manually-actuable means causes said body to slide in the opposite direction in said nest, returning to its first normal latching position, in which position said latch lip is constructed to re-engage said striker bar upon impact of said striker bar;

wherein the edge at said end of said nest opposite to said latch lip is a substantially straight rigid edge directed transverse to the principal axis of said body; and wherein said elastomer spring member at said opposite end comprises a curved finger having one end connected near a lateral edge of said body, the other free end of said finger projecting inward in cantilever fashion in said principal plane, wherein when said body is retracted in slideable relation in the principal plane of said nest from said first normal latching to said second retracted position for releasing engagement of said latch lip with said striker bar, the free end of said elastomer spring member is squeezed against said rigid edge bending said finger towards the center of said principal plane and imposing a spring bias on said body having a major component in the direction of said latch lip.

6. The combination in accordance with claim 5 wherein said manually-actuable means comprise one or more keyholes interposed in the outer surface of said unitary body adjacent said opposite end; and wherein said end opposite said latch lip terminates in a flange directed parallel to the principal plane of said body and forming therewith an inwardly-directed slot, and wherein the curved finger of said elastomer spring member is disposed at one side of said slot to move laterally in said slot when said latch means from a first normally latching position to a second retracted position, and wherein means comprising a boss is disposed at the other side of said slot from said curved finger for frictionally engaging said body to slide said latch in said second retracted position of said latch.

7. The combination in accordance with claim 6 which includes a manually-actuable tool having one or more depending prongs for engagement with said one or more keyholes, and positioned to avoid interference with said elastomer spring member when the same is moved from said first normal latching position to said second retracted position and visa versa.

8. The combination in accordance with claim 6 wherein said one or more keyholes comprise a single key hole, and said manually-actuable tool is a conventional screw-driver.

9. A snap action latching combination comprising elements for installation adjacent the edge of a first door or panel for alternatively maintaining the edge of said first door or panel in spaced-apart open position or in tightly latched abutting position with reference to a striker bar at the edge of a second door or panel, which combination comprises:

a unitary solid body of elastomeric material installed in a nest adjacent the edge of said first door or panel, said unitary body characterized by a principal plane which, upon installation, is substantially parallel to the principal plane of the surface of said first door or panel, said unitary body having at least one latch lip which protrudes outwardly from the edge of said body in a direction both parallel to and normal to said principal plane, said latch lip being stepped back on an inwardly-directed upper surface to form a catch which just accommodates the thickness of said striker bar, the outwardly-directed under surface of said latch lip comprising a protuberance for elastically-deformable engagement with said striker bar;

said nest comprising an opening cut into the surface of said first door or panel for accommodating said body in laterally slideable relation in a plane parallel to said principal plane and in a direction substantially normal to the edge of said first door or panel;

said unitary body having one or more lateral edge slots or grooves for engaging the edges of said nest in said slideable relation;

said body terminating at the end opposite said latch lip in an integrally formed elastomer spring member, the edge of which is extended in said principal plane in a direction opposite to the direction of extent of said latch lip;

the opening comprising said nest having a first forward end for accommodating said latch lip in depending relation therefrom, and a rigid edge at the end of said nest opposite to said latch lip;

the principal plane of said body comprising manually-actuable means for sliding said body longitudinally in said opening from a first normal latching position at the forward end of said nest in which said latch lip is positioned for engagement with said striker bar, to a second retracted position for releasing engagement of said latch lip with said striker bar, and wherein said elastomer spring member at said opposite end is simultaneously deformed by being compressed against said rigid edge opposite said latch lip, thereby imposing a spring-bias on said body, the principal component of which is directed in said principal plane in the direction of said latch lip;

whereby the release of said manually-actuable means causes said body to slide in the opposite direction in said nest, returning to its first normal latching position, in which position said latch lip is constructed to re-engage said striker bar upon impact of said striker bar;

wherein said opening comprising said nest includes a constriction in said rigid edge opposite said latch lip, wherein in said second retracted position said spring member is deformed by being compressed against the walls of said constriction, thereby imposing a spring bias on said body;

wherein the manually-actuable means for sliding said body longitudinally in said opening from a first normal latching position at the forward end of said nest in which said latch lip is positioned for engagement with said striker bar, to a second retracted position for releasing engagement of said latch lip with said striker bar comprises one or more keyholes interposed in the surfaces of said body, which are designed to accommodate a manually-actuable tool for moving said body from said first normal latching position to said second retracted position and vice versa; and means at the end of said body adjacent said elastomer spring member comprising a boss for frictionally engaging said body in retracted position in said nest.

10. The combination in accordance with claim 9 which includes a manually-actuable tool for locked in engagement with said one or more keyholes in the outer surface of said unitary body.

* * * * *